United States Patent [19]

Aoki et al.

[11] Patent Number: 5,009,989

[45] Date of Patent: Apr. 23, 1991

[54] SILVER HALIDE PHOTOGRAPHIC MATERIAL

[75] Inventors: Kozo Aoki; Osamu Takahashi, both of Kanagawa, Japan

[73] Assignee: Fuji Photo Film Co., Ltd., Kanagawa, Japan

[21] Appl. No.: 246,585

[22] Filed: Sep. 19, 1988

[30] Foreign Application Priority Data

Sep. 17, 1987 [JP] Japan ..... 62-233565

[51] Int. Cl.[5] ..... G03C 1/84; G03C 7/34

[52] U.S. Cl. ..... 430/512; 430/546; 430/549; 430/551

[58] Field of Search ..... 430/551, 546, 552, 553, 430/512, 505, 549

[56] References Cited

U.S. PATENT DOCUMENTS

| | | | |
|---|---|---|---|
| 3,748,141, | 7/1973 | Smith | 430/546 |
| 3,948,663 | 4/1976 | Shiba et al. | 430/546 |
| 4,004,928 | 1/1977 | Miyazawa et al. | 430/546 |
| 4,228,235 | 10/1980 | Okonogi et al. | 430/551 |
| 4,419,441 | 12/1983 | Nittel et al. | 430/546 |
| 4,564,590 | 1/1986 | Sasaki et al. | 430/551 |
| 4,622,287 | 11/1986 | Umemoto et al. | 430/505 |
| 4,686,177 | 8/1987 | Aoki et al. | 430/552 |
| 4,748,100 | 5/1988 | Umemoto et al. | 430/551 |
| 4,748,107 | 5/1988 | Umemoto et al. | 430/551 |
| 4,863,840 | 9/1989 | Komorita et al. | 430/551 |
| 4,873,182 | 10/1989 | Delprato et al. | 430/546 |
| 4,916,050 | 4/1990 | Nishijima et al. | 430/551 |
| 4,923,783 | 5/1990 | Kobayashi et al. | 430/546 |

FOREIGN PATENT DOCUMENTS

| | | |
|---|---|---|
| 0084694A1 | 8/1983 | European Pat. Off. . |
| 0166417A3 | 2/1986 | European Pat. Off. . |
| 3527116A1 | 2/1986 | Fed. Rep. of Germany . |
| 1599951 | 10/1981 | United Kingdom . |

*Primary Examiner*—Richard L. Schilling
*Attorney, Agent, or Firm*—Sughrue, Mion, Zinn, Macpeak & Seas

[57] ABSTRACT

A silver halide photographic material which contains, on a support, a combination of at least one cyan dye-forming coupler represented by the following formula (I) and at least one compound selected from among those represented by the following formulae (II) and (III), whereby achieving enhancement of keeping quality of the developed cyan color dye:

(I)

$L_1(COOR_3)_n$ (II)

$L_2(OCOR_4)_m$ (III)

wherein $R_1$ represents an aliphatic group, an aromatic group or a heterocyclic group; $R_2$ representing an alkyl group containing from 2 to 15 carbon atoms; Z represents a hydrogen atom, or a group or an atom capable of splitting off upon coupling with a developing agent; $L_1$ and $L_2$ each represents a divalent to a tetravalent aliphatic group; $R_3$ and $R_4$ each represents an aliphatic group, an aromatic group, or a heterocyclic group; and n and m each represents an integer of from 2 to 4, and therein the n $R_3$'s and m $R_4$'s, respectively, may be the same or different, and when m represents 2, $L_2$ excludes a cyclohexylene group.

8 Claims, No Drawings

SILVER HALIDE PHOTOGRAPHIC MATERIAL

FIELD OF THE INVENTION

The present invention relates to a silver halide photographic material and, more particularly, to a silver halide photographic material which can produce color images having an improved preservability.

BACKGROUND OF THE INVENTION

In the color development of a silver halide light-sensitive material after imagewise exposure, an aromatic primary amine developing agent oxidized by the silver halide reacts with dye-forming-couplers to form color images.

In this process, color reproduction utilizing the subtractive color method is generally carried out, and images of yellow, magenta and cyan colors bearing a complementary relationship to blue, green and red tints, respectively, are formed.

Hitherto, phenols and naphthols have been used as cyan color image-forming couplers in most cases. However, the preservability of color images produced from conventional phenols and naphthols have some unsolved problems. For instance, color images produced from the cyan couplers of the 2-acylaminophenol type, as disclosed in U.S. Pat. Nos. 2,367,531, 2,369,929, 2,423,730 and 3,772,002, generally are inferior with respect to heat resistance; and those produced from cyan couplers of the 2,5-diacylaminophenol type, as disclosed in U.S. Pat. Nos. 2,772,162 and 2,895,826, generally are inferior in light resistance. In addition, color images obtained from the cyan couplers of the 2-ureidophenol type are, in general, inferior with regard to light resistance, and those of the cyan coupler of 1-hydroxy-2-naphthamide type are generally insufficient in both heat resistance (particularly to high temperature and high humidity resistance) and light resistance, as disclosed in U.S. Pat. Nos. 3,446,622 and 4,333,999.

Moreover, the cyan couplers of the 2-acylaminophenol type, including those represented by formula (I) of this invention had showed defects in that they tended to cause a lowering of their color-forming power when a developer free from benzyl alcohol having a heavy load of environmental pollution was used. Accordingly, when it was intended to ensure a high color-forming power to such couplers, cyan color formation occurred in uncolored areas in a lapse of time resulting in generation of color stain.

On the other hand, though the examples of using di- to tricarboxylic acid esters as high boiling point organic solvents have been disclosed in JP-B-53-12378 (the term "JP-B" as used herein refers to an "examined Japanese patent publication"), JP-A-54-106228 (the term "JP-A" as used herein refers to a "published unexamined Japanese patent application") and JP-A-54-118246, the achieved fastness was still insufficient in the combined use with the phenol type cyan couplers having methyl or methoxy groups at the 5-position, which were specified therein.

SUMMARY OF THE INVENTION

A first object of the present invention is to provide a silver halide photographic material which can produce color images having excellent resistance to light, heat, and conditions of high temperature and humidity.

A second object of the present invention is to provide a silver halide photographic material which enables the enhancement of the color-forming power of a cyan coupler incorporated therein, without being attended by cyan coloration in the uncolored areas (white background areas) which has so far occurred with the lapse of time.

The above-described objects are attained with a silver halide photographic material which contains, on a support, at least one cyan dye-forming coupler represented by the following formula (I) and at least one compound selected from among those represented by the following formulae (II) and (III):

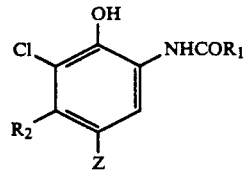

(I)

$$L_1\text{-}(COOR_3)_n \quad \text{(II)}$$

$$L_2\text{-}(OCOR_4)_m \quad \text{(III)}$$

wherein $R_1$ represents an aliphatic group, an aromatic group or a heterocyclic group; $R_2$ represents an alkyl group containing from 2 to 15 carbon atoms; Z represents a hydrogen atom, or a group or an atom capable of splitting off upon coupling with a developing agent; $L_1$ and $L_2$ each represents a divalent to a tetravalent aliphatic group; $R_3$ and $R_4$ each represents an aliphatic group, an aromatic group, or a heterocyclic group; and n and m each represents an integer of from 2 to 4, wherein said n $R_3$'s and m $R_4$'s, respectively, may be the same or different.

DETAILED DESCRIPTION OF THE INVENTION $R_1$, $R_2$, $R_3$, $R_4$, $L_2$, $L_2$ and Z in the foregoing formulae (I), (II) and (III) are described in detail below.

The term "an aliphatic group" as used in this specification describes all aliphatic hydrocarbon residues having straight chain, branched chain and cyclic forms, including saturated ones, such as alkyl groups, and unsaturated ones, such as alkenyl and alkynyl groups, and further those having substituent groups. As examples of typical aliphatic groups, mention may be made of methyl, ethyl, butyl, dodecyl, octadecyl, eicosenyl, isopropyl, tert-butyl, tert-octyl, tert-dodecyl, cyclohexyl, cyclopentyl, allyl, vinyl, 2-hexadecenyl, propargyl, and substituted groups thereof.

Also, the terms "an aromatic group" and "a heterocyclic group" used herein are intended to include those having substituted group(s) on their unsaturated or saturated rings in addition to unsubstituted ones.

$R_1$, $R_3$ and $R_4$ in formulae (I), (II) and (III), respectively, represent an aliphatic group having preferably from 1 to 36 carbon atoms, an aromatic group having preferably from 6 to 36 carbon atoms (e.g., phenyl, naphthyl), or a heterocyclic group comprising 5 or 6-membered ring containing at least one of N-atom, O-atom and S-atom as a hetero-atom, which ring nay be substituted (e.g., 3-pyridyl, 2-furyl). These groups may further be substituted by group(s) selected from among an alkyl group, an aryl group, a heterocyclic group, an alkoxy group (e.g., methoxy,2-methoxyethoxy), an aryloxy group (e.g., 2,4-di-tert-amylphenoxy, 2-chlorophenoxy, 4-cyanophenoxy), an alkenyloxy group (e.g., 2-propenyloxy), an acyl group (e.g., acetyl, benzoyl), an ester group (e.g., butoxycarbonyl, phenoxycarbonyl, acetoxy, benzoyloxy, butoxysulfonyl, toluenesulfonyloxy), an amido group (e.g., acetylamino, ethylcarbamoyl, dimethylcarbamoyl, methanesulfonamido, butylsulfamoyl), a sulfamido group (e.g., dipropylsulfamoylamino), an imido group (e.g., succinimido, hydantoinyl), a ureido group (e.g., phenylureido, dimethylureido), an aliphatic or aromatic sulfonyl group (e.g., methanesulfonyl, phenylsulfonyl), an aliphatic or aromatic thio group (e.g., ethylthio, phenylthio), a hydroxy group, a cyano group, a carboxyl group, a nitro group, a sulfo group, a halogen atom, and so on.

However, the cases in which $R_3$ and $R_4$ have epoxy groups as substituents are excluded.

$R_2$ in formula (I) is an alkyl group having from 2 to 15 carbon atoms, which may assume a straight chain, branched chain or cyclic form, and may contain a substituent group.

$L_1$ and $L_2$ in formulae (II) and (III), respectively, represent a divalent to pentavalent aliphatic group, and include those transformed from the foregoing monovalent aliphatic groups so as to increase the number of bonding positions. The aliphatic group represented by $L_1$ and $L_2$ has preferably 1 to 20 and more preferably 2 to 12 carbon atoms. Typical examples of such groups in the case of n, m =2, there are an alkylidene group (e.g., methylidene, ethylidene, cyclohexylidene), an alkylene group (e.g., ethylene, trimethylene, hexamethylene, undecamethylene, 1,2-cyclohexylene, 1,4-cyclohexylene, 3,8-tricyclo-[5,2,1,0,2,6]decylene), an alkenylene group (e.g., vinylene, propenylene, 4-cyclohexene-1,2-pentenylene), and so on and of them an alkylene group is preferable. When m represents 2, $L_2$ excludes a cyclohexylene group. In the case of n, m =3, typical examples a cyclohexylene group (e.g., 1,2,3-propanetriyl, alkenetriyl group (e.g., 1,2,3-propenetriyl, 2-propene-1,2,4-triyl), and so on. In the case of n, m =4, examples are an alkanetetrayl group (e.g., 1,2,3,4-butanetetrayl, 1,3-propanediyl-2-ylidene, 2,2-bismethylene-1,3-propanediyl), an alkenetetrayl group (e.g., 3-octene-1,3,5,8-tetrayl), and so on.

Z in formula (I) represents a hydrogen atom releasable or a coupling releasable group, with specific examples including a halogen atom (e.g., fluorine, chlorine, bromine), an alkoxy group (e.g., ethoxy, dodecyloxy, methoxyethylcarbamoylmethoxy, carboxypropyloxy, methylsulfonylethoxy), an aryloxy group (e.g., 4-chlorophenoxy, 4-methoxyphenoxy, 4-carboxyphenoxy), an acyloxy group (e.g., acetoxy, tetradecanoyloxy, benzoyloxy), a sulfonyloxy group (e.g., methanesulfonyloxy, toluenesulfonyloxy), an amido group (e.g., dichloroacetylamino, heptafluorobutyrylamino, methanesulfonylamino, toluenesulfonylamino), an alkoxycarbonyloxy group (e.g., ethoxycarbonyloxy, benzyloxycarbonyloxy), an aryloxycarbonyloxy group (e.g., phenoxycarbonyloxy), an aliphatic or aromatic thio group (e.g., ethylthio, phenylthio, tetrazolylthio), an imido group (e.g., succinimido, hydantoinyl), an aromatic azo group (e.g., phenylazo), and so on. These eliminatable groups may contain a photographically useful group. As for the photographically useful group, groups containing a development inhibitor or accelerator moiety can be employed.

The cyan coupler may form a dimer or a polymer via $R_1$ in formula (I).

Groups preferable for $R_1$ in formula (I) include those having 8 or more carbon atoms, preferably substituted or unsubstituted alkyl groups. Therein, unsubstituted alkyl groups are preferred. In particular, unsubstituted alkyl groups having from 12 to 18 carbon atoms are favored.

$R_2$ in formula (I) is preferably an alkyl group having from 2 to 4 carbon atoms, especially ethyl group.

Z in formula (I) is preferably a hydrogen atom or a halogen atom, more preferably a chlorine atom or a fluorine atom.

The preferred total number of the carbon atoms in the molecule represented by formula (II), which comprises n $R_3$,'s and $L_1$, and that in the molecule represented by formula (III), which comprises m $R_4$,'s and $L_2$, are each within the range of 12 to 60, especially 16 to 36.

In formulae (II) and (III), both n and m are preferably 2 or 3.

In formulae (II) and (III), groups preferred as $R_3$ and $R_4$, respectively, are aliphatic groups.

In formulae (II) and (III), compounds represented by formula (II) are more preferably than compounds represented by formula (III).

Specific examples of the cyan coupler represented by formula (I) are illustrated below. However, the invention should not be construed as being limited to these examples.

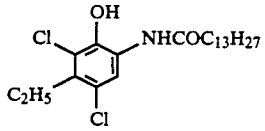

(I-1)

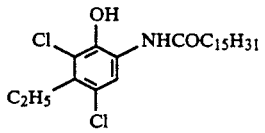

(I-2)

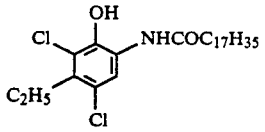

(I-3)

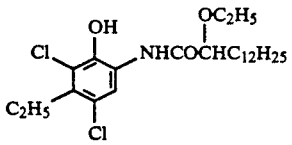

(I-4)

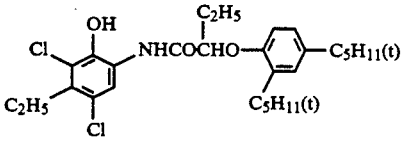

(I-5)

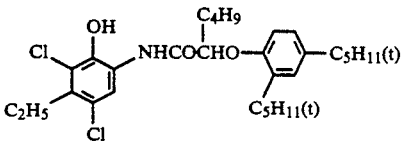

(I-6)

-continued
(I-7)
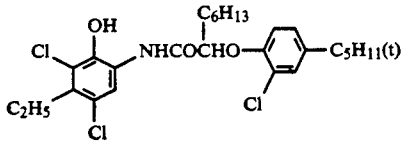
(I-8)
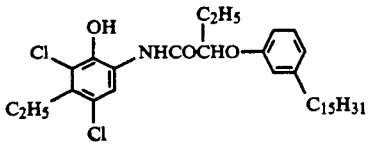
(I-9)
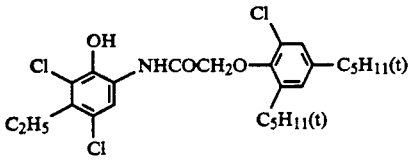
(I-10)
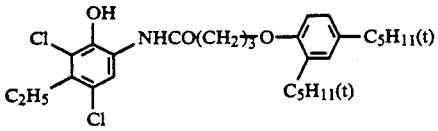
(I-11)
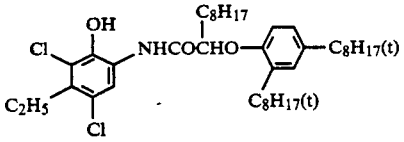
(I-12)
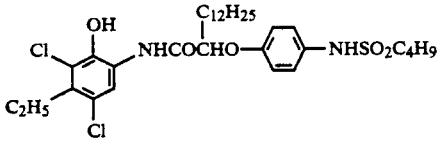
(I-13)
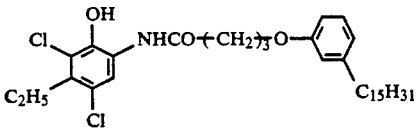
(I-14)
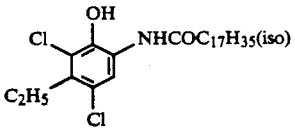
(I-15)
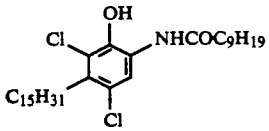
(I-16)
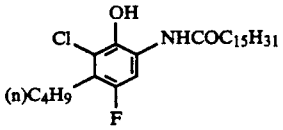
(I-17)
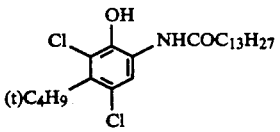
-continued
(I-18)
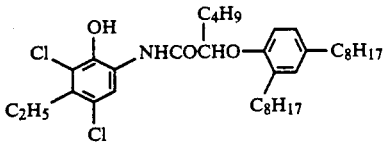
(I-19)
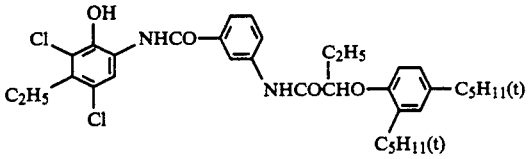
(I-20)
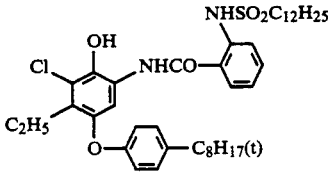
(I-21)
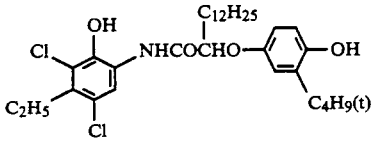
(I-22)
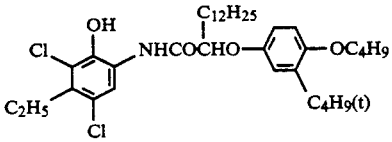
Specific examples of the compounds represented by formulae (II) and (III), respectively, are illustrated below. However, the invention should not be construed as being limited to the following examples.
II-1
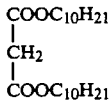
II-2
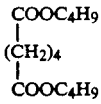
II-3
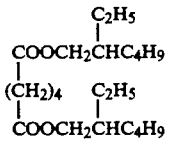
II-4
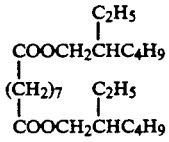
II-5
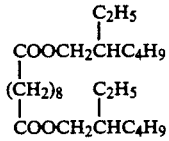

-continued
II-6
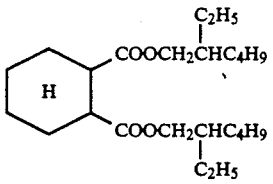
II-7
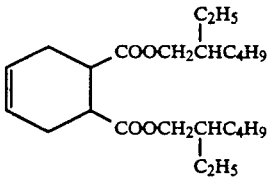
II-8
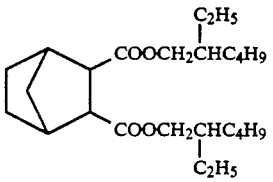
II-9
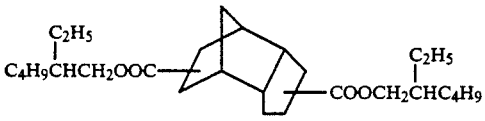
II-10
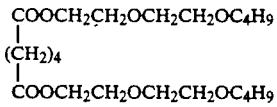
II-11
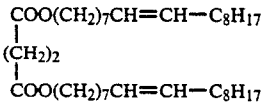
II-12
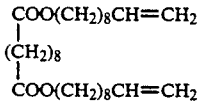
II-13
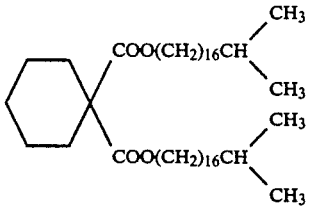
II-14
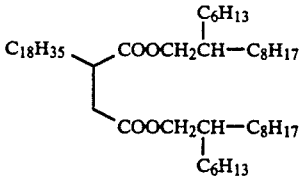
II-15
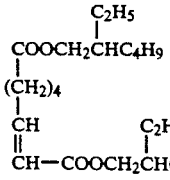
-continued
II-16
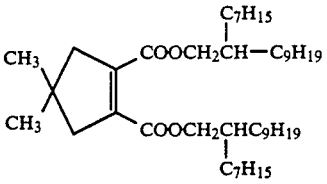
II-17
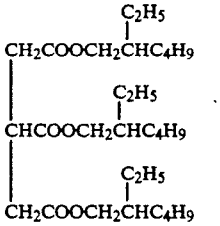
II-18
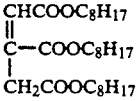
II-19
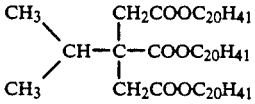
II-20
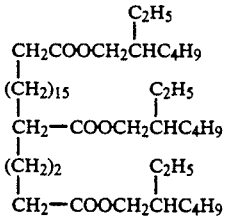
II-21
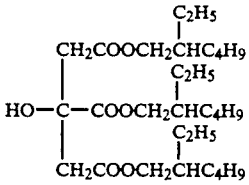
II-22
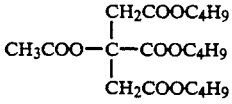
II-23
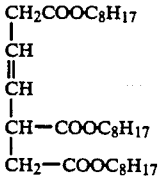
II-24
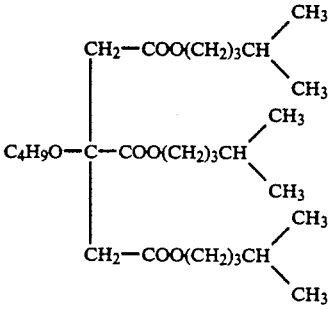

-continued
II-25
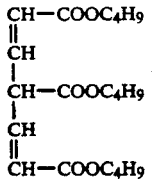
II-26
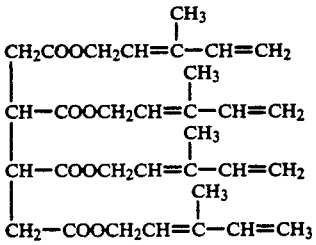
II-27
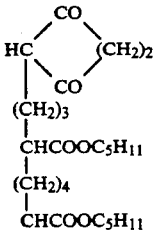
II-28
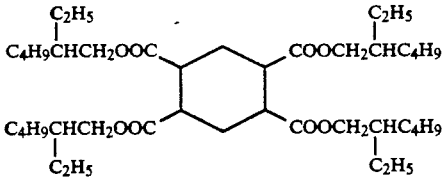
III-1
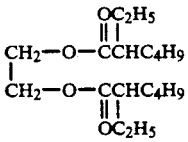
III-2
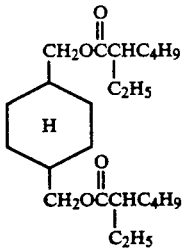
III-3
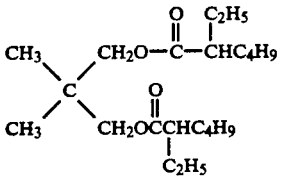
III-4
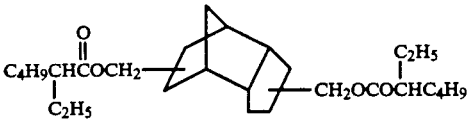
-continued
III-5
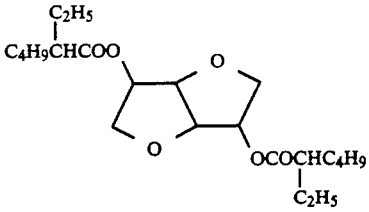
III-6
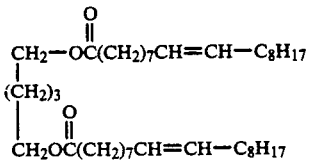
III-7
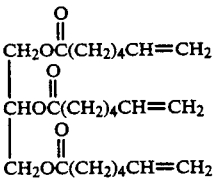
III-8
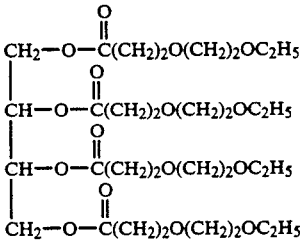
III-9
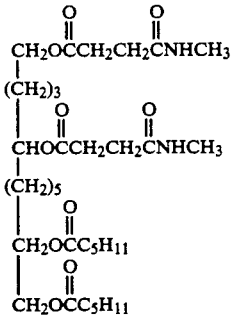
III-10
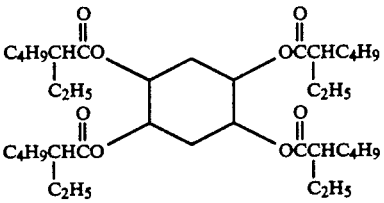
III-11
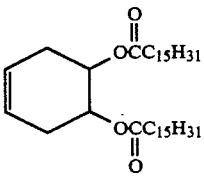

-continued

III-12

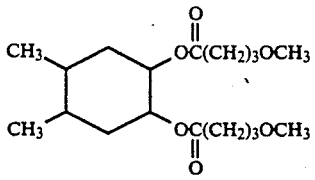

III-13

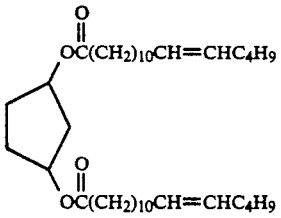

III-14

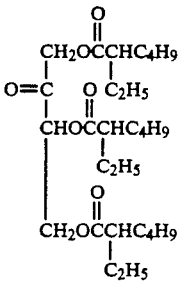

III-15

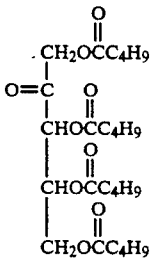

The cyan coupler represented by formula (I) are synthesized by a process as disclosed in U.S. Pat. Nos. 3,772,002 and 4,564,590, and JP-A-61-39045, and 62-70846. The compound represented by formulae (II) and (III) are synthesized by a process as disclosed in JP-B-53-12378 and JP-A-54-106228, 54-118246 and 62-215272.

The present photographic material comprises the combined use of a coupler represented by formula (I), which tends to cause cyan coloration in the white background, with a compound represented by formulae (II) or (III). This combined use accomplishes the excellent effect of ridding stain in the white background area of cyan coloration in a substantial sense.

In order to fully achieve the effect of the present invention, the compound represented by formulae (II) or (III) is preferably used in an amount of from 0.1 to 10 parts by weight, more preferably from 0.2 to 2 parts by weight, per part by weight of the coupler of formula (I).

Two or more of the couplers represented by formula (I) in the present invention may be used together, and other known cyan couplers may also be used in the layer in which the cyan coupler of formula (I) is incorporated, or in a different layer. Among known cyan couplers, those which can be particularly preferably used together with the couplers of the present invention are represented by the following formula (C-I):

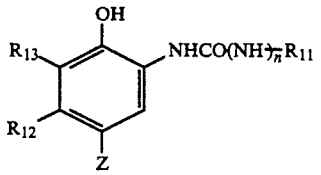

(C-I)

In the above formula (C-I), $R_{11}$ represents an aliphatic group, an aromatic group, or a heterocyclic group ($R_{11}$ represents the same groups as those represented by $R_1$ in formula (I)); $R_{12}$ represents a methyl group or an acylamino group; $R_{13}$ represents a hydrogen atom, a halogen atom (such as chlorine atom, bromine atom and fluorine atom), an aliphatic group such as a lower alkyl group (e.g., methyl, ethyl and the like), an aromatic group (such as phenyl group), an aliphatic oxy group such as methyloxy, ethyloxy and the like, an aromatic oxy group such as phenyloxy and the like, or an acylamino group; $Z_{11}$ represents a hydrogen atom, or a group releasable by oxidative coupling with a color developing agent; and n is 0 or 1. Further, $R_{12}$ and $R_{13}$ may combine with each other to complete a 5- to 7-membered ring.

Of cyan couplers represented by formula (C-I), preferable coupler includes a coupler having an acylamino group at 2-position and an alkyl group at 5-position of phenol nucleus as disclosed in U.S. Pat. Nos. 2,369,929, 4,518,867 and 4,511,647; 2,5-diacylaminophenol coupler as disclosed in U.S. Pat. Nos. 2,772,162, 2,895,862, 4,334,011, 4,500,635, 4,557,99.9, 4,565,777, 4,124,396, and 4,613,564; a cyan coupler having a nitrogen containing heterocyclic ring condensed with phenol nucleus as disclosed in U.S. Pat. Nos. 4,327,173, 4,564,586, and 4,430,423 and a cyan coupler having a ureido group at 2-position of phenol nuclues as disclosed in U.S. Pat. Nos. 4,333,999, 4,451,559, 4,444,872, 4,427,767, and 4,579,813.

Typical examples of cyan couplers represented by formula (C-I) are illustrated below.

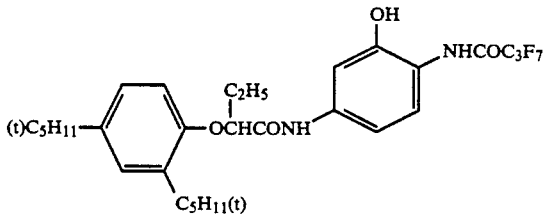

(C-I)

-continued
(C-2)
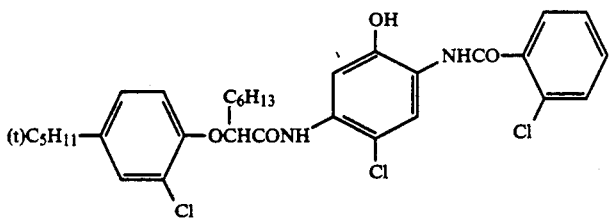
(C-3)
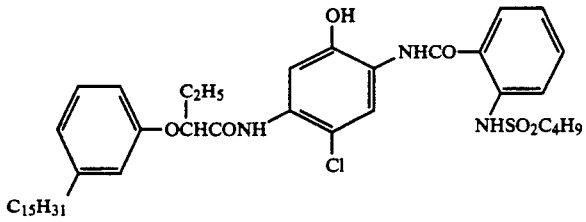
(C-4)
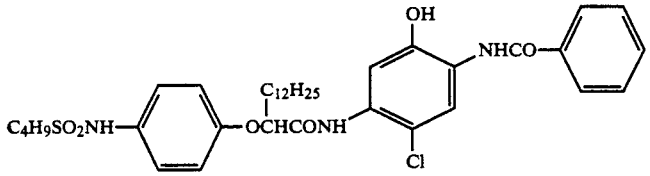
(C-5)
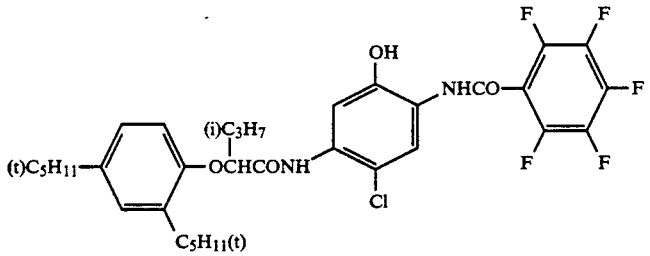
(C-6)
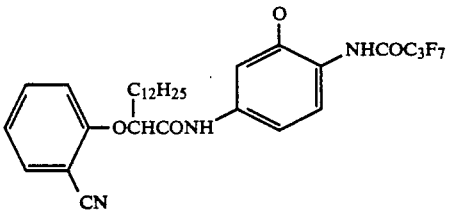
(C-7)
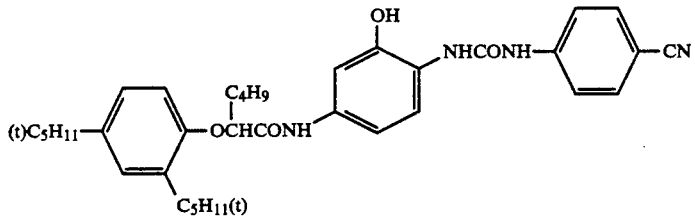
(C-8)
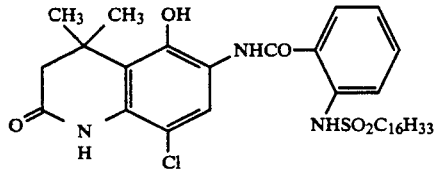

-continued (C-9)

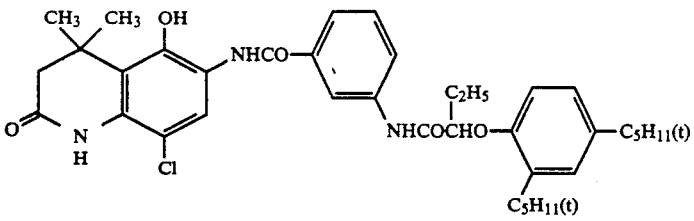

(C-10)

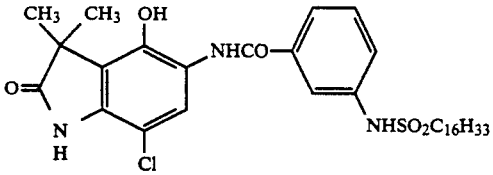

(C-11)

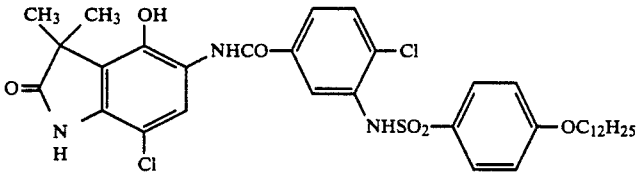

(C-12)

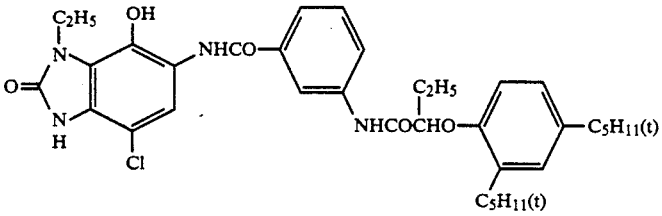

(C-13)

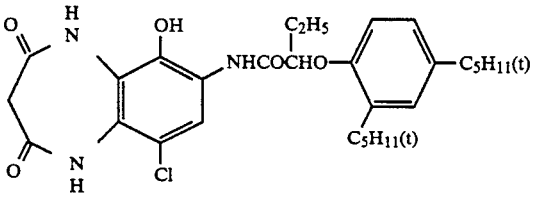

(C-14)

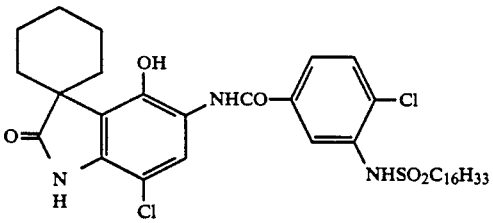

(C-15)

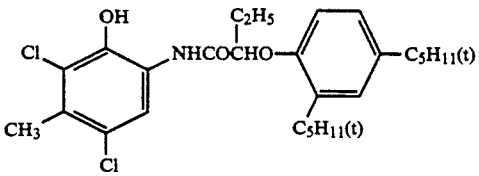

The couplers usable in the present invention can be introduced into silver halide emulsion layers according to known methods. The coupler is preferably co-emulsified together with the compound of formula (II) or (III) to form emulsified dispersion, resulting in mixing with silver halide emulsion. The cyan coupler (I) and the compound represented by formula (II) or (III) are incorporated in the same one hydrophilic coolidal layer or different hydrophilic coolidal layers.

In an embodiment of co-emulsification of the coupler and the compound formula (II) or (III),the coupler may be used together with a-coupler solvent. Additives which can be introduced together with the couplers include ultraviolet absorbents, protective colloids, binders, antifoggants, color mixing inhibitors, discoloration inhibitors, sensitizing dyes, dyes, bleaching agents and so on, the preparation of the silver halide photosensitive material (including the methods of making photographic emulsions, the process of introducing couplers and so on, usable supports, the layer structure of sensitive layers, and so on) and the photographic processing thereof, the substances and the methods described in literature described or cited in *Research Disclosure,* Item 17643, Industrial Opportunities Ltd., UK (December, 1978), JP-A-56-65134, JP-A-56-10433, and so on, can be employed.

The coupler(s) of the present invention is incorporated in a silver halide emulsion layer, which is a constituent of the light-sensitive layer. The cyan coupler of formula (I), or optionally further cyan coupler of formula (C-I) is used in an amount of generally from about $1\times10^{-3}$ to 1.0 mol, preferably from $5\times10^{-2}$ to $5\times10^{-1}$ mol and more preferably $1\times10^{-1}$ to $5\times10^{-1}$ mol per mol of silver halide.

In the present invention, a color photographic light-sensitive material can be produced by combining at least one of the cyan couplers represented by formula (I) with a magenta coupler and a yellow coupler.

Among yellow couplers usable in the present invention, acylacetamide derivatives, such as benzoylacetanilides and pivaloylacetanilides, are desirable.

In particular, the yellow couplers represented by the following formulae (Y-1) and (Y-2) are preferred:

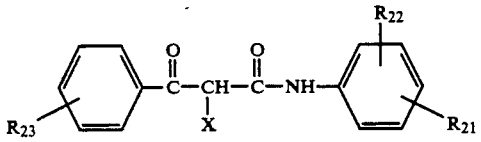

(Y-1)

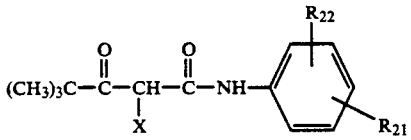

(Y-2)

In the above formulae, X represents a hydrogen atom or a coupling releasable group. $R_{21}$ represents a nondiffusible group having from 8 to 32 carbon atoms in all, and $R_{22}$ represents a hydrogen atom, one or more of a halogen atom, a lower alkyl group, a lower alkoxy group, or a nondiffusible group having from 8 to 32 carbon atoms in all. $R_{23}$ represents a hydrogen atom, or a substituent group. When plural $R_{23}$'s are present, they may be the same or different.

For details of the yellow couplers of pivaloylacetanilide type the descriptions in U.S. Pat. No. 4,622,287, from column 3, line 15 to column 8, line 39; U.S. Pat. No. 4,623,616, from column 14, line 50 to column 19, line 41, can be referred to.

For details of the yellow couplers of benzoylacetanilide type the descriptions in U.S. Pat. Nos. 3,408,194, 3,933,501, 4,046,575, 4,133,958 and 4,401,752, and so on, can be referred to.

As specific examples of the yellow couplers of pivaloylacetanilide type, mention may be made of the compounds exemplified as Compounds (Y-1) to (Y-39) in the above-cited U.S. Pat. No. 4,622,287, from the column 37 to column 54. Among them, Compounds (Y-1), (Y-4), (Y-6), (Y-7), (Y-15), (Y-21), (Y-22), (Y-23), (Y-26), (Y-35), (Y-36), (Y-37), (Y-38) and (Y-39), are preferred In addition, the compounds exemplified as Compounds (Y-1) to (Y-33) in the above-cited U.S. Pat. No. 4,623,616, from 19th column to 24th column can be used. Among them, Compounds (Y-2), (Y-Y), (Y-8), (Y-12), (Y-20), (Y-21), (Y-23) and (Y-29), are favored.

Other desirable examples of yellow couplers include the compound exemplified as a typical compound example (34) in U.S. Pat. No. 3,408,194, 6th column; the compounds exemplified as compound examples (16) and (19) in U.S. Pat. No. 3,933,501, 8th column; the compound exemplified as a compound example (9) in U.S. Pat. No. 4,046,575, from 7th column to 8th column; the compound exemplified as a compound example (1) in U.S. Pat. No. 4,133,958, from 5th column to 6th column; the compound exemplified as a compound example 1 in U.S. Pat. No. 4,401,752, 5th column; and the following compounds a) to g).

General Formula

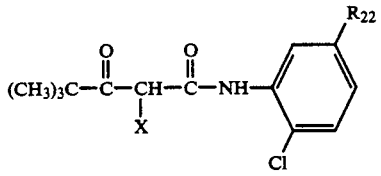

| Compound | $R_{22}$ | X |
|---|---|---|
| a | $-COOCH(CH_3)COOC_{12}H_{25}$ | 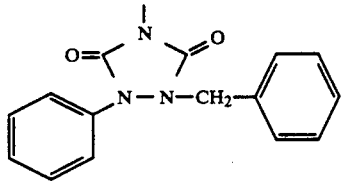 |
| b | $-COOCH(C_4H_9)COOC_{12}H_{25}$ | same as the above |

-continued

General Formula

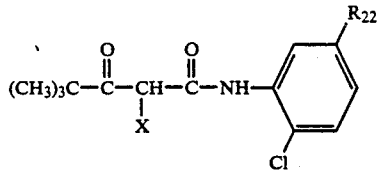

| Compound | $R_{22}$ | X |
|---|---|---|
| c | 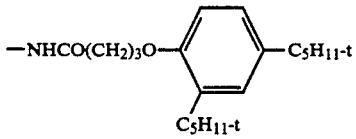 | 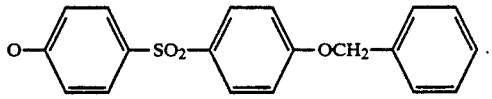 |
| d | same as the above | 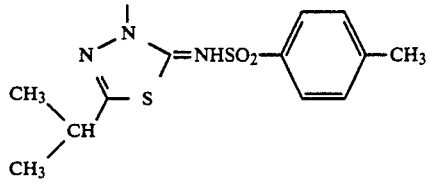 |
| e | same as the above | 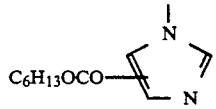 |
| f | $-NHSO_2C_{12}H_{25}$ | 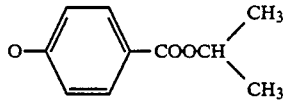 |
| g | $-NHSO_2C_{16}H_{33}$ | 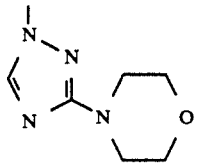 |

Among the above-cited couplers, those having a nitrogen atom at the coupling releasable site are particularly favored.

As for the magenta couplers usable in the present invention, oil-protected couplers of the indazolone type or cyanoacetyl type, and preferably 5-pyrazolone type and pyrazoloazole type (such as pyrazolotriazoles), can be used. In the class of 5-pyrazolone couplers, those substituted by an arylamino or acylamino group at the 3-position are preferred over others from the standpoints of hue and color density of developed dyes, and the representative examples thereof are described, e.g., in U.S. Pat. Nos. 2,311,082, 2,343,703, 2,600,788, 2,908,573, 3,062,653, 3,152,896 and 3,936,015, and so on. As for the coupling eliminatable groups of 2-equivalent 5-pyrazolone couplers, those having a nitrogen atom at the coupling eliminatable site as disclosed in U.S. Pat. No. 4,310,619, and the arylthio groups disclosed in U.S. Pat. No. 4,351,897 and WO 88/04795 are flavored. Also, high color densities of developed images can be obtained by 5-pyrazolone couplers having a ballast group, as disclosed in European Patent 73,636.

As examples of couplers of the pyrazoloazole type, mention may be made of the pyrazolobenzimidazoles disclosed in U.S. Pat. No. 3,369,879, and preferably the pyrazolo[5,1-c]]1,2,4]triazoles disclosed in U.S. Pat. No. 3,725,067, the pyrazolotetrazoles described in *Research Disclosure,* Item 24220 (June, 1984) and the pyrazolopyrazoles described in *Research Disclosure,* Item 24230 (June, 1984). The above-cited couples each may be a polymer form.

The foregoing couplers are represented by the following formulae (M-1), (M-2) and (M-3).

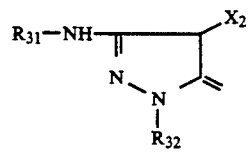

(M-1)

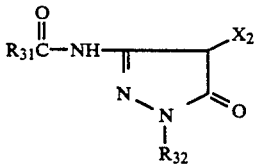

(M-2)

-continued (M-3)

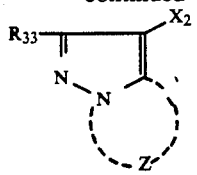

wherein $R_{31}$ represents a nondiffusible group having from 8 to 32 carbon atoms in all $R_{32}$ represents an unsubstituted or substituted phenyl group; $R_{33}$ represents a hydrogen atom, or a substituent group; and Z represents nonmetal atoms necessary to complete a 5-membered ring containing 2 to 4 nitrogen atoms, and the azole ring therein may have a substituent group (including a condensed ring).

$X_2$ represents a hydrogen atom or a coupling eliminatable group. For details of the substituent groups which $R_{33}$ and the azole ring can have, for instance, the descriptions in U.S. Pat. No. 4,540,654, from the 2nd column, line 41 to 8th column, line 27, can be referred to.

Among the couplers of the pyrazoloazole type, imidazo[1,2-b]pyrazoles, as disclosed in U.S. Pat. No. 4,500,630 are favored, and pyrazolo[1,5-b][1,2,4]-triazoles disclosed in U.S. Pat. No. 4,540,654 are particularly preferred over others in the respect that the side absorption in the yellow region is small and light resistance is high.

In addition, pyrazolotriazole couplers having a branched chain alkyl group at the 2-, 3- or 6-position thereof, as disclosed in JP-A-61-65245, pyrazoloazole couplers containing a sulfonamido group inside a molecule, as disclosed in JP-A-61-65246, pyrazoloazole couplers containing an alkoxyphenylsulfonamido group as a ballast group, as disclosed in JP-A-61-147254, and pyrazolotriazole couplers containing an alkoxy or aryloxy group at the 6-position, as disclosed in EP-A-226,849, can be preferably employed.

Specific examples of these couplers are illustrated below.

| Compound | $R_{33}'$ | $R_{34}$ | $X_2$ |
|---|---|---|---|
| | | 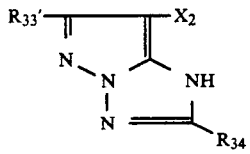 | |
| M-1 | $CH_3$— | 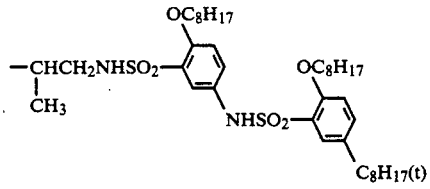 | Cl |
| M-2 | $CH_3$— | 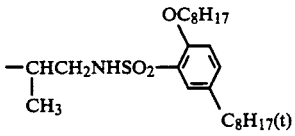 | Cl |
| M-3 | $CH_3$— | 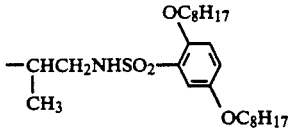 | 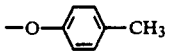 |
| M-4 | 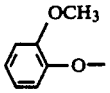 | 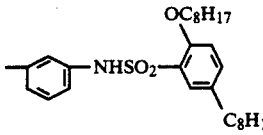 | 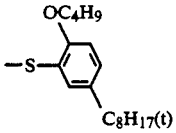 |
| M-5 | $CH_3$— | 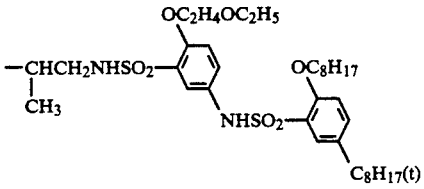 | Cl |

-continued
| Compound | $R_{33}'$ | $R_{34}$ | $X_2$ |
|---|---|---|---|
| M-6 | $CH_3-$ | 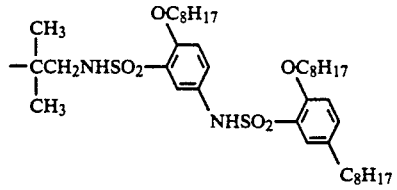 | Cl |
| M-7 | 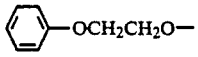 | 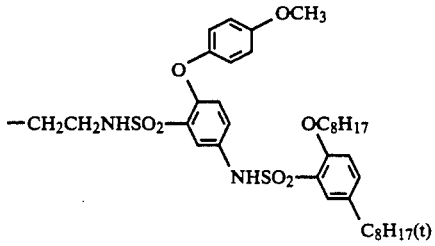 | 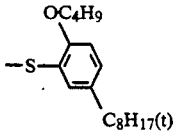 |
| M-8 | $CH_3CH_2O-$ | same as the above | same as the above |
| M-9 | 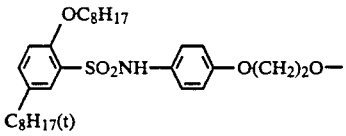 | 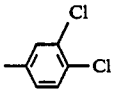 | |
| M-10 | 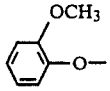 | 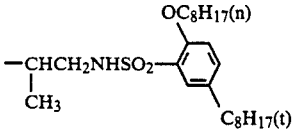 | Cl |
| | | 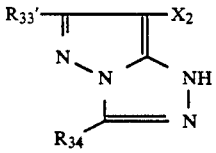 | |
| M-11 | $CH_3-$ | 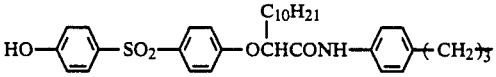 | Cl |
| M-12 | same as the above | 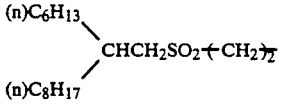 | same as the above |
| M-13 | 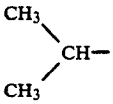 | 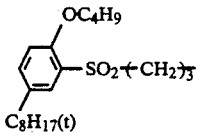 | same as the above |
| M-14 | 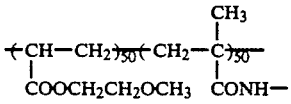 | 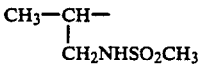 | same as the above |
| M-15 | 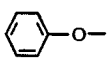 | 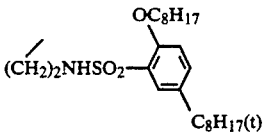 | Cl |

-continued

| Compound | $R_{33}'$ | $R_{34}$ | $X_2$ |
|---|---|---|---|
| M-16 | 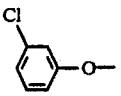 | 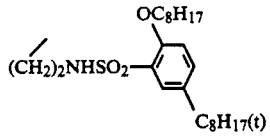 | 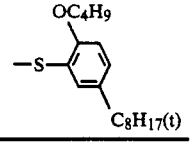 |

High boiling point organic solvents which can be used as a coupler solvent in the present invention are preferably those having a boiling point higher than 160° C. under ordinary pressure. Examples of such solvents include esters (such as phosphoric acid esters, phthalic acid esters, fatty acid esters, benzoic acid esters and the like), phenols, aliphatic alcohols, carboxylic acids, ethers, amides (such as fatty acid amides, benzoic acid amides, sulfonic acid amides, cyclic imides and the like), aliphatic hydrocarbons, halogenated compounds, and sulfone derivatives. In dissolving photographic additives, such as couplers, etc., into these high boiling point organic solvents for addition to silver halide emulsions, low boiling point organic solvents having a boiling point of from 30° C. to 160° C. (such as ethylacetate, butylacetate, ethylpropionate, methylisobutylketone, cyclohexanone, β-ethoxyethylacetate, dimethylformamide and the like) may be mixed together, if needed. These mixtures are firstly dispersed into a hydrophilic colloid solution in the form of emulsion, and then added to photographic emulsions. Thereafter, only the low boiling organic solvents may be removed by vacuum concentration, washing or so on.

Such high boiling point organic solvents as described above are used in an amount of 0 to 20 parts by weight, preferably 0.2 to 3 parts by weight, to the photographic additives to be dissolved therein.

Preferred examples of the high boiling point organic solvents are illustrated below.

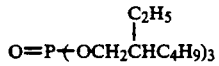

(0-1)

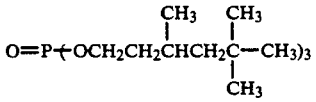

(0-2)

$O{=}P{\leftarrow}OC_{12}H_{25})_3$ (0-3)

$O{=}P{\leftarrow}OCH_2CH_2OC_4H_9)_3$ (0-4)

$O{=}P{\leftarrow}OCH_2CH_2CH_2Cl)_3$ (0-5)

(0-6)

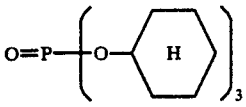

(0-7)

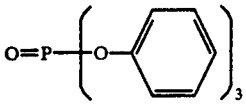

(0-8)

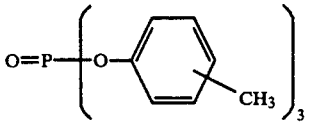

(m, p mixture)

-continued (0-9)

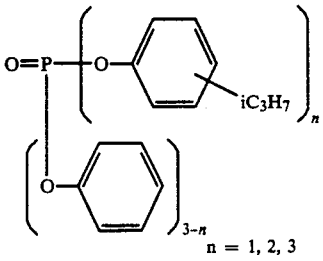

n = 1, 2, 3

(0-10)

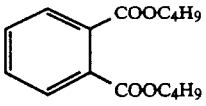

(0-11)

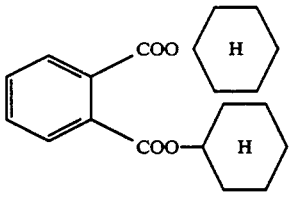

(0-12)

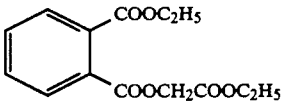

(0-13)

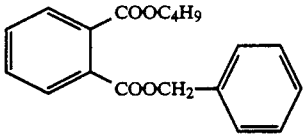

(0-14)

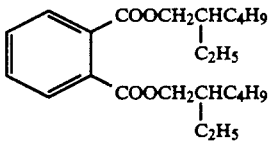

(0-15)

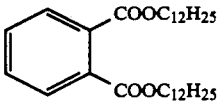

(0-16)

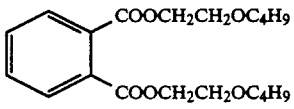

-continued (0-17)

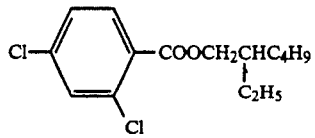

(0-18)

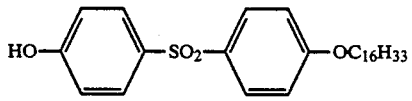

(0-19)

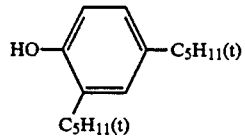

(0-20)

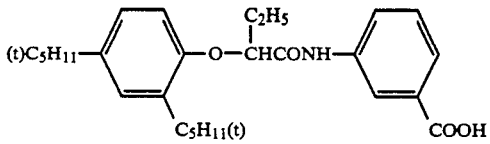

(0-21)

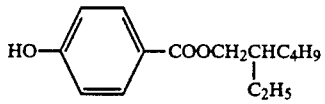

(0-22)

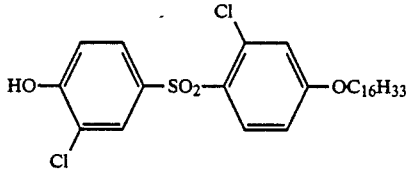

(0-23)

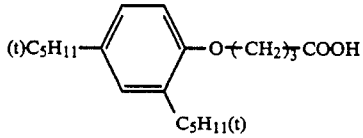

(0-24) $C_8H_{17}CH{=}CH(CH_2)_7COOC_4H_9$ (0-25)

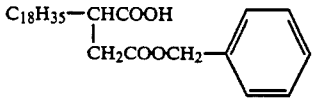

(0-26)

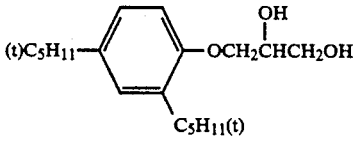

(0-27) $(C_2H_5)_2NCO(CH_2)_8COOCH_2CHC_4H_9$ ($C_2H_5$)

(0-28) $C_nH_{2n+2}$ n = 10~20 paraffin (0-29) $CH_3COCH_2COOC_{12}H_{25}$ (0-30)

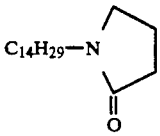

-continued (0-31)

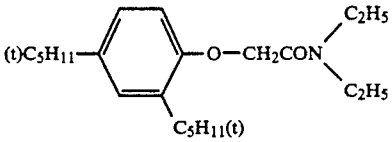

(0-32) $C_{12}H_{18}Cl_8$ chlorinated paraffin (0-33)

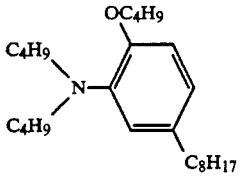

(0-34)

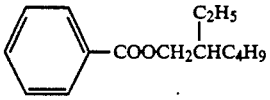

The group "(t)$C_8H_{17}$" represents 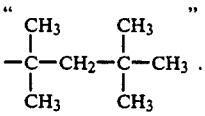 .

The present invention can accomplish further enhanced effects when the compounds of the present invention are used in combination with at least one ultraviolet absorbent.

The ultraviolet absorbent can be added to any constituent layer of the photographic material. Preferably, it is incorporated in the layer containing the cyan coupler of the present invention, or the layer adjacent thereto. Ultraviolet absorbents usable in the present invention include the compounds cited in *Research Disclosure,* (RD No. 17643), Item VIII-C. Among them, benzotriazole derivatives represented by the following formula (XI) are favored.

(XI)

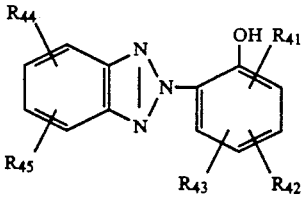

In the above formula, $R_{41}$, $R_{42}$, $R_{43}$, $R_{44}$ and $R_{45}$ may be the same or different, each being a hydrogen atom or a substituent group. As this substituent group, those groups by which the aliphatic or aryl group represented by $R_1$ in formula (I) is substituted may be used. $R_{44}$ and $R_{45}$ may combine with each other to complete a 5- or 6-membered aromatic carbon ring. These groups and this aromatic ring may further be substituted by a substituent group.

The compounds represented by the foregoing formula (XI) can be used as a mixture of two or more thereof. The representative compounds which can be used as ultraviolet absorbents in the present invention are illustrated below. In these chemical structures, the skeleton

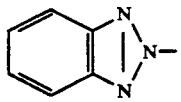
can assume the structure
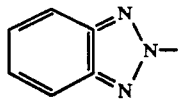
through the mechanism of resonance.
(UV-1)
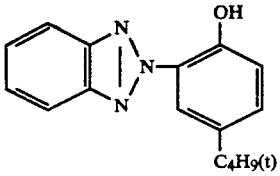
(UV-2)
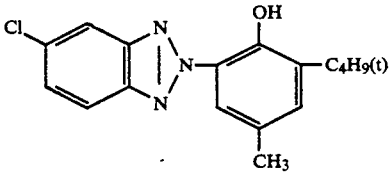
(UV-3)
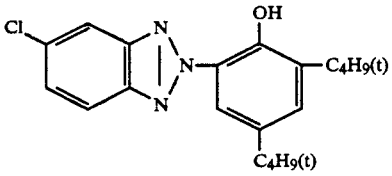
(UV-4)
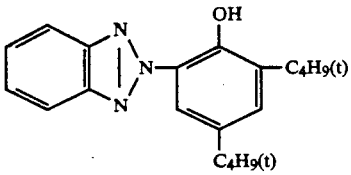
(UV-5)
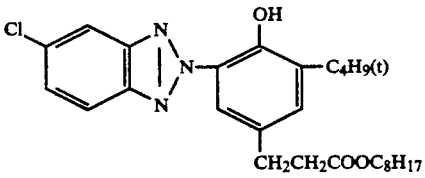
(UV-6)
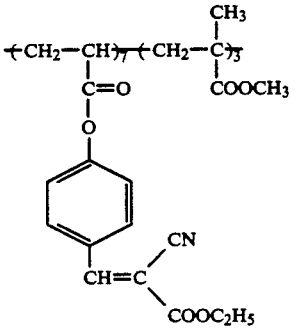
-continued
(UV-7)
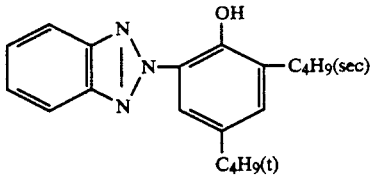
(UV-8)
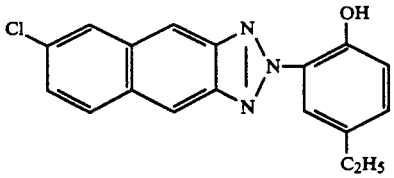
(UV-9)
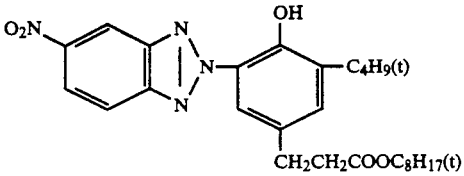
(UV-10)
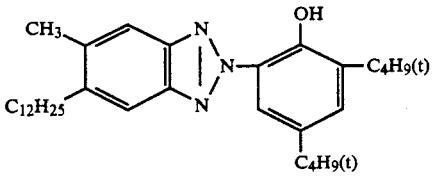
(UV-11)
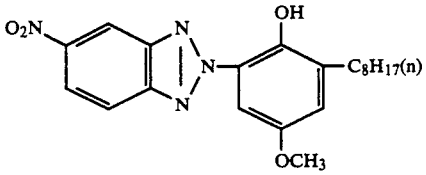
(UV-12)
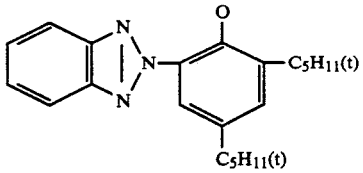
(UV-13)
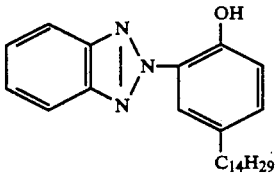
(UV-14)
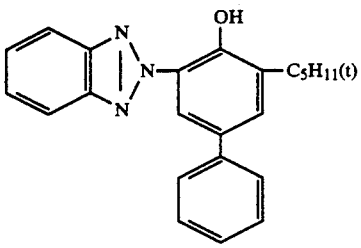

-continued (UV-15)

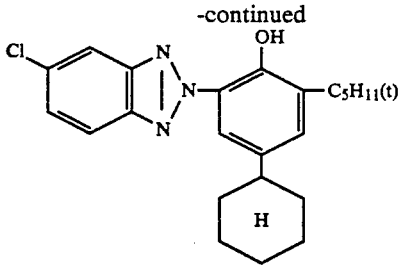

(UV-16)

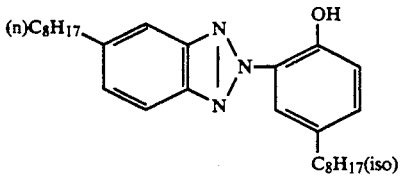

(UV-17)

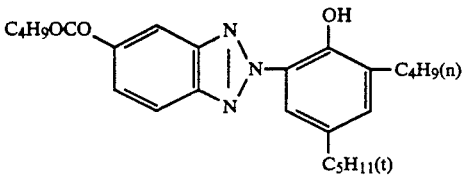

(UV-18)

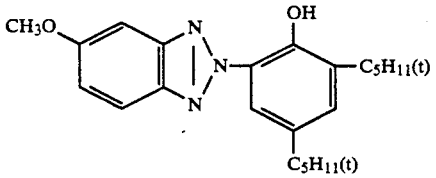

(UV-19)

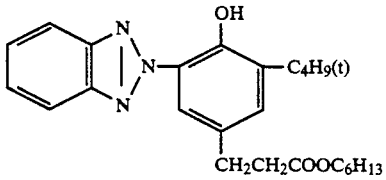

(UV-20)

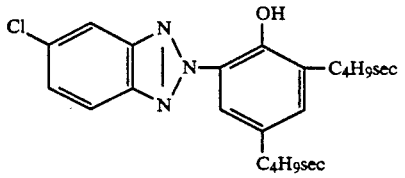

Preparation methods of the compounds represented by the foregoing formula (XI) and other compound examples are described in JP-B-44-29620, JP-A-50-151149, JP-A-54-95233, U.S. Pat. No. 3,766,205, EP-0057160, *Research Disclosure*, (RD No. 22519) (1983), and so on. In addition, high molecular weight ultraviolet absorbents disclosed in JP-A-58-111942, JP-A-58-178351 (British Patent 2118315A), U.S. Pat. No. 4,455,368, and JP-A-59-19945 (British Patent 2127569A) can be employed, and an example thereof is cited as UV-6 illustrated above. Also, low and high molecular weight ultraviolet absorbents can be used together.

In a manner similar to the coupler case, the ultraviolet absorbents described above can be dispersed into a hydrophilic colloid in the form of emulsion. The photosensitive material of the present invention is not particularly restricted with respect to the proportion of the high boiling point organic solvent used to the ultraviolet absorbents dissolved therein. In general, a high boiling point organic solvent is used in a proportion of 0 to 300% to the weight of ultraviolet absorbents to be dissolved therein. Ultraviolet absorbents which are liquid at ordinary temperatures are preferred, and they are used alone or in a combination of two or more thereof.

When the ultraviolet absorbents represented by formula (XI) are used together with the combination of the couplers of the present invention, keeping qualities, particularly light resistance, of the developed color images, especially of the cyan image, can be improved. The ultraviolet absorbents and the couplers may be co-emulsified.

As for the total amount of the ultraviolet absorbents, an amount large enough to impart light stability to the cyan dye image is proper. However, when they are used in too large of an amount, the unexposed area of the color photographic light-sensitive material changes its color from white to yellow. Therefore, preferred amounts of the ultraviolet absorbents generally ranges from $1\times10^{-4}$ to $2\times10^{-3}$ mol/m$^2$, particularly from $5\times10^{-4}$ to $1.5\times10^{-3}$ mol/m$^2$.

As examples of color mixing inhibitors which can be used in the present invention, there are various kinds of reducing agents, including hydroquinones. The most representative reducing agents are alkylhydroquinones. For instance, using monoalkyl-substituted hydroquinones as a color mixing inhibitor in an interlayer are disclosed in U.S. Pat. Nos. 2,360,290, 2,419,613, 2,403,721, 3,960,570 and 3,700,453, JP-A-49-106329, JP-A-50-156438, and so on. The use of dialkyl-substituted hydroquinones are disclosed in U.S. Pat. Nos. 2,728,659, 2,732,300, 3,243,294 and 3,700,453, JP-A-50156438, JP-A-53-9528, JP-A-53-55121, JP-A-54-29637, JP-A-60-55339 and so on. Alkylhydroquinones which can be preferably used in the present invention are represented by the following formula (XII).

(XII)

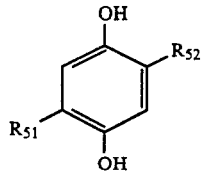

In the foregoing formula, $R_{51}$ and $R_{52}$ each represents a hydrogen atom, or a substituted or unsubstituted alkyl group (having from 1 to 20 carbon atoms, e.g., methyl, t-butyl, n-octyl, sec-octyl, t-octyl, sec-dodecyl, t-pentadecyl, sec-octadecyl), provided that either $R_{51}$ or $R_{52}$ is an alkyl group.

Also, hydroquinone sulfonates can be preferably used as a color mixing inhibitor, as disclosed in U.S. Pat. No. 2,701,197, JP-A-60-172040, and so on. Hydroquinone sulfonates which can be preferably used as a color mixing inhibitor in the present invention are represented by the following formula (XIII).

(XIII)

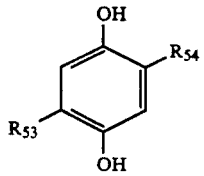

In the above formula, $R_{53}$ represents a substituted or unsubstituted alkyl, alkylthio, amido or alkoxy group, and $R_{54}$ represents a sulfo group, or a sulfoalkyl group (e.g., sulfopropyl).

Further, amidohydroquinones can be preferably employed as a color mixing inhibitor. The descriptions thereof can be found, e.g., in JP-A-59-202465, Japanese Patent Application Nos. 60-165511 and 60-296088, and so on. Amidohydroquinones which can be preferably used as color mixing inhibitors in the present invention are represented by the following formula (XIV).

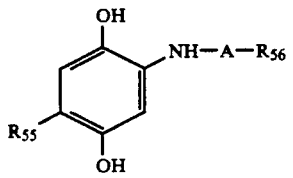

(XIV)

In the above formula, $R_{55}$ represents a hydrogen atom, a halogen atom, or a substituted or unsubstituted alkyl group having carbon atoms sufficient to provide non-diffusibility to the whole molecule. A represents —CO— or —$SO_2$—, and $R_{56}$ represents a substituted or unsubstituted alkyl or aryl group.

Furthermore, hydroquinones having an electron attracting substituent group, as disclosed in JP-A-55-43521, JP-A-56-109344 and JP-A-57-22237, other than the above-illustrated alkylhydroquinones, hydroquinone sulfonates and amidohydroquinones, can be preferably used. Specific examples of hydroquinones which are preferred as color mixing inhibitor in the present invention are set forth below.

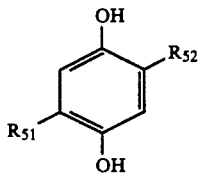

| Compound | $R_{51}$ | $R_{52}$ |
|---|---|---|
| HQ-1 | (t)$C_8H_{17}$— | —$C_8H_{17}$(t) |
| HQ-2 | (t)$C_6H_{13}$— | —$C_6H_{13}$(t) |
| HQ-3 | (sec)$C_8H_{17}$— | —$C_8H_{17}$(sec) |
| HQ-4 | (n)$C_8H_{17}$— | —$C_8H_{17}$(n) |
| HQ-5 | $CH_3$— | —$C_8H_{17}$(t) |
| HQ-6 | " | —$C_{18}H_{37}$(sec) |
| HQ-7 | (n)$C_{16}H_{33}$— | —$SO_3Na$ |
| HQ-8 | (n)$C_{16}H_{33}S$— | " |
| HQ-9 | H | 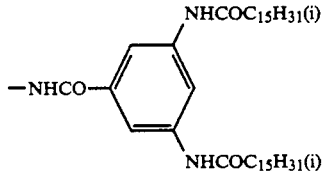 |
| HQ-10 | " | 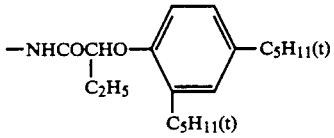 |
| HQ-11 | (n)$C_{15}H_{31}$— | 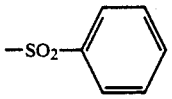 |
| HQ-12 | H | 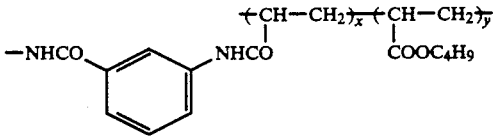 x:y = 2:5 mean molecular weight: about 20,000 |

Reducing agents having skeletons, other than a hydroquinone skeleton, can also be employed as color mixing inhibitors. As examples of such reducing agents, there are gallic acid amides, as disclosed in JP-A-58-156933, sulfonamidophenols, as disclosed in JP-A-59-5247 and JP-A-59-202465, and so on. Specific examples are illustrated below.

(RD-1)

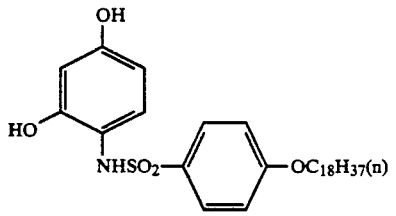

(RD-2)

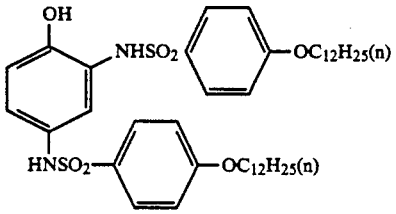

(RD-3)

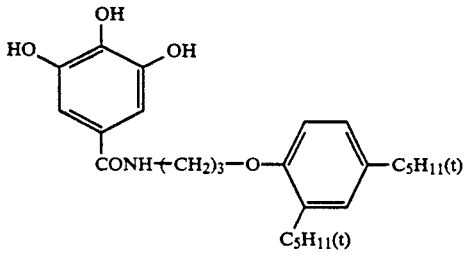

These color mixing inhibitors may be used as a mixture with the couplers.

In order to enhance the keeping qualities of developed color images, particularly yellow and magenta images, the couplers can be used together with a wide variety of discoloration inhibitors of the organic or metal complex type. Examples of discoloration inhibitors of the organic type include hydroquinones, gallic acid derivatives, p-alkoxyphenols, p-oxyphenols, and so on. As for the dye image stabilizers, the stain inhibitors or the antioxidants, the patents thereof are cited in *Research Disclosure,* (RD No. 17643), Item VII-I or VII-J. On the other hand, discoloration inhibitors of the metal complex type are described in *Research Disclosure,* (RD No. 15162), and so on.

In order to heighten the heat and light resistance of a yellow dye image, phenols, hydroquinones, hydroxychromans, hydroxycoumarans, hindered amines, and other compounds belonging to alkyl ethers, silyl ethers and derivatives of hydrolytic precursors of the above-cited compounds, can be used.

In the hydrophilic colloid layers which constitute the photosensitive material of the present invention, water-soluble dyes may be contained as filter dyes or for other purposes, including antiirradiation. Suitable examples of such dyes include oxonol dyes, hemioxonol dyes, styryl dyes, merocyanine dyes, cyanine dyes and azo dyes. Among these dyes, oxonol dyes and hemioxonol dyes are particularly useful.

As for the binder or the protective colloid which can be used for the emulsion layers of the photosensitive material of the present invention, gelatin is advantageously used. Of course, other hydrophilic colloids can be used alone or together with gelatin.

Gelatin which can be used in the present invention may be lime-processed or acid-processed. Details of the preparation methods of gelatins are described in Arthur Weiss, *The Macromolecular Chemistry of Gelatin,* Academic Press (1964).

The silver halide which can be used in the photographic emulsion layers of the photographic light-sensitive material of the present invention may include any of silver bromide, silver iodobromide, silver iodochlorobromide, silver chlorobromide, and silver chloride.

The average grain size of the silver halide grains in the photographic emulsions (which is represented by the average diameter of the circles having the same areas as the projected areas of the grains using an average edge length as a grain size when the grains are cubic, or by the diameter of grains in case of spherical or nearly spherical grains, though not particularly limited, is preferably 2 μm or less, more preferably 0.2 to 2 μm.

The distribution of grain sizes may be either broad or narrow. However, monodisperse emulsions having a variation coefficient of 15% or less are used to advantage.

The silver halide grains in the photographic emulsion layers may have a regular crystal form, such as that of a cube or an octahedron; and irregular crystal form, such as that of sphere, a plate or so on; or a composite form thereof. A mixture of various crystal forms of silver halide grains may also be present. Among them, normal crystal grain emulsions are preferred.

Also, a silver halide emulsion in which tabular silver halide grains having a diameter larger than thickness by a factor of 5 or more are present in a fraction of 50% or more, based on the total projected area of the whole grains, may be used.

The interior and surface phases of the silver halide grains may differ. Further, either silver halide grains of the kind which form latent images predominantly at the surface of the grains, or grains of the kind which mainly form latent images inside the grains, can be used.

In a process of producing silver halide grains or allowing the produced silver halide grains to ripen physically, cadmium salts, zinc salts, thallium salts, lead salts, iridium salts or complexes, rhodium salts or complexes, iron salts or complexes and/or the like may be present.

In general, the silver halide emulsions are chemically sensitized.

The photographic emulsions which can be used in the present invention can contain a wide variety of compounds for the purposes of preventing fog or stabilizing photographic function during production, storage, or photographic processing, including azoles (such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially, 1-phenyl-5-mercaptotetrazole), mercaptopyrimidines, mercaptotriazines and so on); thioketo compounds (such as oxazolidinethione); azaindenes (such as triazaindenes, tetraazaindenes (especially 4-hydroxy-substituted (1,3,3a,7)-tetraazaindenes), pentaazaindenes, and so on); and compounds which are known as antifoggants or stabilizers (such as benzenethiosulfonates, benzenesulfinic acid, benzenesulfonic acid amides, etc.).

The present invention can also be applied to a multilayer, multicolor photographic material having at least two different color sensitivities on a support. A multilayer color photographic material has, in general, at least one red-sensitive emulsion layer, at least one green-sensitive emulsion layer and at least one blue-sensitive emulsion layer on a support. The order of these layers can be varied as desired. Usually cyan-, magenta- and yellow-forming couplers are incorporated in red-, green- and blue-sensitive emulsion layers, respectively. However, different combinations can also be employed, if desired.

A support which can be used in the present invention include those conventionally used in photographic light-sensitive materials, such as a cellulose nitrate film, a cellulose acetate film, a cellulose acetate butyrate film, a cellulose acetate propionate film, a polystyrene film, a polyethylene terephthalate film, a polycarbonate film, laminates made up of two or more of these films, a thin glass film, paper, and so on. Also, other supports, such as paper coated or laminated with baryta or a polymer of an α-olefin containing 2 to 10 carbon atoms, particularly, polyethylene, polypropylene or ethylene/butene copolymer, a film of vinyl chloride resin containing a reflecting material like $TiO_2$, plastic films whose adhesiveness to other high molecular substances is improved by a surface roughening treatment as described in JP-B-47-19068, and so on, produce satisfactory results. Resin being hardened by ultraviolet ray is also useful.

These supports may be rendered transparent or opaque depending on the end use purpose of the photosensitive material. Further, they can be colored by the addition of a dye or a pigment, as their transparency is kept.

Opaque supports include not only originally opaque ones like paper, but also those obtained by adding dyes or pigments, such as titanium oxide, to transparent films, plastic films rendered opaque by surface treatments carried out using methods, as described in JP-B-47-19068, and paper and plastic films to which carbon black, dyes or the like are added so as to completely cut out light. Usually a subbing layer is provided on a support. In order to further improve on the adhesiveness of the support, the support surface is subjected to a pretreatment, such as corona discharge, ultraviolet irradiation or flame treatment.

The silver halide photographic material of the present invention can be applied to general color photosensitive materials, particularly to those for print use.

A color developer which can be used for the development processing of the photosensitive material according to the present invention is preferably an alkaline aqueous solution containing as a main component a developing agent of the aromatic primary amine type. Though aminophenol compounds are also useful as color developing agents, p-phenylenediamine compounds are preferred. As representative examples of p-phenylenediamine compounds, there are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and the sulfates, hydrochlorides or p-toluenesulfonates of these anilines. These compounds can be used as a mixture of two or more thereof, depending on the intended use.

In addition, the color developer generally contains pH buffering agents (such as carbonates, borates or phosphates of alkali metals), and development inhibitors or antifoggants (such as bromides, iodides, benzimidazoles, benzothiazoles or mercapto compounds). Further, it can optionally contain various kinds of preservatives (such as hydroxylamine, diethylhydroxylamine, sulfites, hydrazines, phenylsemicarbazides, triethanolamine, catechol sulfonic acids, and triethylenediamine(1,4-diazabicyclo[2,2,2]-octane)); organic solvents (such as ethylene glycol, and diethylene glycol); development accelerators (such as benzyl alcohol, polyethylene glycol, quaternary ammonium salts, and amines); dye-forming couplers; competing couplers; fogging agents (such as sodium borohydride); auxiliary developers (such as 1-phenyl-3-pyrazolidone); viscosity imparting agents; chelating agents (such as aminopolycarboxylic acids, aminopolyphosphonic acids, alkylphosphonic acids, and phosphonocarboxylic acids, with specific examples including ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediaminedi(o-hydroxyphenylacetic acid), and the salts thereof). The developer preferably contains benzyl alcohol in an amount of 2 ml/l or less, and more preferably 0.5 ml/l or less based on the developer. It is desired that benzyl alcohol should not substantially be used as a development accelerator from the standpoint of the environmental preservation. Most preferably, the developer contains no benzyl alcohol.

In carrying out reversal processing, the color development generally succeeds to black-and-white development. Black-and-white developers which can be used include dihydroxybenzenes, such as hydroquinone, 3-pyrazolidones like 1-phenyl-3-pyrazolidone, aminophenols like N-methyl-p-aminophenol, and others conventionally used.

In general, the pH of such a color developer and a black-and-white developer, as described above, ranges from 9 to 12, and more preferably from 10 to 11.

The amount of a replenisher to be added to the foregoing developers, though dependent on the chosen color photographic material, is generally less than 3 liters per square meter of the photographic material. When a replenisher having a reduced bromide ion concentration is used, the replenishing amount can be even reduced to less than 500 ml. In using a reduced amount of replenisher, it is desired that evaporation and aerial oxidation of the developer be prevented by diminishing the contact area of the processing tank with the atmosphere. Also, reduction in the amount of replenisher to be added can be achieved by employing means of suppressing the accumulation of bromide ion in the developer.

After color development, the photographic emulsion layer is generally subjected to a bleach processing. The bleach processing may be carried out simultaneously with a fixation processing (a bleach-fix processing), or separately therefrom. For the purpose of quickening the photographic processing, the bleach processing may be succeeded by the bleach-fix processing. Also, the processing may be performed with two successive bleach-fix baths, or the fixation processing may be succeeded by the bleach-fix processing, or the bleach-fix processing may be succeeded by the bleach processing, as desired. Examples of bleaching agents which can be used include compounds of polyvalent metals (such as Fe(III), Co(III), Cr(VI), Cu(II), etc.); peroxy acids; quinones; nitro compounds; and so on. More specifically, ferricyanides; dichromates; organic complex salts formed by Fe(III) or Co(III), and aminopolycarboxylic acids, such as ethylenediaminetetraacetic acid, diethylenetriaminepentaacetic acid, cyclohexanediaminetetraacetic acid, methyliminodiacetic acid, 1,3-diaminopropanetetraacetic acid, glycol ether diamine tetraacetic acid, etc., citric acid, tartaric acid, malic acid, or so on; persulfates; hydrobromides; permanganates; nitrobenzenes; and so on, can be used as the bleaching agents. Of these bleaching agents, aminopolycarboxylic acid Fe(III) complex salts, including (ethylenediaminetetraacetato) iron(III) complex, and persulfates, are preferred over others, with respect to rapid processing and prevention of environmental pollution. In particular, aminopolycarboxylic acid Fe(III) complex salts are useful in both bleaching baths and bleach-fix baths. The pH of the bleaching or bleach-fix bath which uses an aminopolycarboxylic acid Fe(III) complex salt as a bleaching agent generally ranges from 5.5 to 8, but the processing can be performed under a lower pH for the purpose of increasing the processing speed.

In the bleaching bath, the bleach-fix bath and prebaths thereof, bleach accelerators can be used, if needed. Specific examples of useful bleach accelerators include compounds having a mercapto group or a disulfide linkage group, as described in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-141623, JP-A-53-124,424, JP-A-53-28426, *Research Disclosure,* (RD No. 17129) (July, 1978), and so on; thiazolidine derivatives as described in JP-A-50-140129; thiourea derivatives as described in JP-B-45-8506, JP-A-52-20832, JP-A-53-32735, and U.S. Pat. No. 3,706,561; iodides as described in West German Patent 1,127,715 and JP-A-58-16235; polyoxyethylene compounds as described in West German Patents 966,410 and 2,748,430; polyamine compounds as described in JP-B-45-8836; compounds described in JP-A-49-42434, JP-A-49-59644, JP-A-53-94927, JP-A-54-35727, JP-A-55-26506 and JP-A-58-163940; bromide ion; and so on. Of these bleach accelerators, compounds having a mercapto group or a disulfide linkage are preferred over others because of their great effect upon bleach acceleration. In particular, the compounds described in U.S. Pat. No. 3,893,858, West German Patent 1,290,812 and JP-A-53-95630 are effective. In addition, the compounds described in U.S. Pat. No. 4,552,834 are favored. These bleach accelerators may be incorporated in the photosensitive material. When color photosensitive materials for photograph-taking are subjected to a bleach-fix processing, these bleach accelerators can produce a particularly great effect.

As examples of fixers which can be used, there may be used thiosulfates, thiocyanates, thioether compounds, thioureas, a large amount of iodide, and so on. Of these fixers, thiosulfates, especially ammonium thiosulfate are generally used. As the preservatives for the bleach-fix bath, sulfites, bisulfites or adducts of carbonyl compounds and bisulfite, are preferably used.

After a desilvering step, the silver halide color photographic material of the present invention is, in general, subjected to a washing step and/or a stabilizing step. A volume of washing water required can be determined variously depending on the characteristics of photosensitive materials to be processed (e.g., on what kinds of ingredients including couplers are incorporated therein), the intended use of photosensitive materials to be processed, the temperature of washing water, the number of washing tanks (stage number), the way of replenishing washing water (as to, e.g., whether a current of water flows in the counter direction, or not), and other various conditions. Of these conditions, the relation between the number of washing tanks and the volume of washing water in the multistage countercurrent process can be determined according to the methods described in *Journal of the Society of Motion Picture and Television Engineers,* Vol. 64, pages 248 to 253 (May, 1955).

According to the multistage countercurrent process described in the above-cited literature, the volume of washing water can be sharply decreased. However, the process had disadvantages, e.g., in that bacteria propagate themselves in the tanks because of an increase in staying time of water in the tanks, and suspended matter produced from the bacteria sticks to photosensitive materials processed therein. As a means of solving such problems caused in the processing of the color photosensitive material of the present invention when the above-described process is applied, the method of reducing the contents of calcium ion and magnesium ion described in Japanese Patent Application No. 61-131632, can be employed to great advantage. Further, isothiazolone compounds and thiapentazole described in JP-A-57-8542; chlorine-containing germicides such as sodium salts of chlorinated isocyanuric acid; and benzotriazoles and other germicides as described in Hiroshi Horiguchi, *Bokin Bobai Zai no Kaoaku* (which means "Chemistry of Antibacteria and Antimolds"), *Biseibutsu no Mekkin Sakkin Bobai Gijutsu* (which means "Art of Sterilizing and Pasteurizing Microbe, and Proofing Against Mold"), compiled by Eisei Gijutsu Kai, and *Bokin and Bobai Zai Jiten* (which means "Thesaurus of Antibacteria and Antimolds"), compiled by Nippon Bokin Bobai Gakkai.

Washing water used in the processing of the photosensitive material of the present invention is adjusted to a pH of from 4 to 9, preferably to a pH of from 5 to 8. The washing temperature and a washing time though, can be chosen depending on the characteristics and the intended use of the photosensitive material to be washed, and are generally from 20 seconds to 10 minutes at 15° C. to 45° C., or 30 seconds to 5 minutes at 25° C. to 0° C.

Also, the photosensitive material of the present invention can be processed directly with a stabilizing solution in place of using the above-described washing water. Known methods, such as described in JP-A-57-8543, JP-A-58-14834 and JP-A-60-20345, can be applied to the stabilization processing in the present invention.

In some cases, a washing processing as described above is further succeeded by a stabilization processing. As an example of a stabilizer used therein, there is a stabilizing bath containing formaldehyde and a surface active agent which has been conventionally used as the final bath of color photosensitive materials for photograph taking. To such a stabilizing bath also, various kinds of chelating agents and antimolds can be added. Washing water and/or the stabilizer which overflows the processing baths with the replenishment thereof, can also be reused in other steps such as the desilvering step.

For the purposes of simplification and quickening of photographic processing, a color developing agent may be incorporated in the silver halide color photosensitive material of the present invention. Therein, it is desirable that the color developing agent should be used in the form of precursors of various types. For instance, compounds of the indoaniline type, as described in U.S. Pat. No. 3,342,597; compounds of the Schiff base type, as described in U.S. Pat. No. 3,342,599 and *Research Disclosure,* (RD Nos. 14850 and 15159); aldol compounds, as described in *Research Disclosure,* (RD No. 13924); metal complex salts, as described in U.S. Pat. No. 3,719,492; and compounds of the urethane type, as described in JP-A-53-135628, can be used.

In the silver halide photosensitive material used in the present invention, various 1-phenyl-3-pyrazolidones may be incorporated for the purpose of accelerating color development. Typical examples of such compounds are described in JP-A-56-64339, JP-A-57-144547, JP-A-58-115438, and so on.

The temperature of each processing bath used in the present invention ranges from 10° C. to 50° C., and more preferably 30° C. to 50° C. Though a standard temperature is within the range of 33° C to 38° C, temperatures higher than the standard temperature can be adopted for the reduction of the processing time through acceleration of the processing, while those lower than the standard temperature can enable the achievement of improved image quality and enhanced stability of the processing bath. Further, processing utilizing a cobalt intensification method or a hydrogen peroxide intensification method, as described in West German Patent 2,226,770 or U.S. Pat. No. 3,674,499, may be carried out for the purpose of saving silver.

The present invention is illustrated in greater detail by reference to the following examples. However, the invention should not be construed as being limited to these examples.

EXAMPLE 1

A solution prepared by heating, at 50° C., a mixture composed of 10 g of the present coupler (I-2), 10 g of the foregoing (O-10) and 20 ml of ethyl acetate was dispersed, in an emulsified condition, into 80 g of a gelatin solution containing a 1% water solution of sodium dodecylbenzenesulfonate.

Then, the resulting emulsified dispersion was mixed with 145 g of a red-sensitive silver chlorobromide emulsion (bromide fraction: 50 mol%, Ag content: 7 g), and thereto was added sodium dodecylbenzenesulfonate as a coating aid. The thus-prepared emulsion was coated on a paper support laminated with polyethylene on both sides. The coverage of the coupler was adjusted to 400 mg/m$^2$. On the emulsion layer, gelatin was coated at a coverage of 1 g/m$^2$ as a protective layer. The thus-obtained sample was identified as Sample 1.

Sample films were prepared in the same manner as Sample 1, except the combinations set forth in Table 1 were used in place of the combination of Couplers (I-2) and (O-10). Also, when the compounds represented by formulae (II) or (III), which are the additives of the present invention, were used in place of (O-10), each was added in the same weight as (O-10), while when each was used together with oil, their amounts were half the original weight of (O-10).

The pH inside the sample films 1 to 19 was approximately 6.

TABLE 1

| Sample Film | Coupler | Additive | High Boiling Solvent | Remarks |
|---|---|---|---|---|
| 1 | (I-2) | — | (O-10) | Comparison |

TABLE 1-continued

| Sample Film | Coupler | Additive | High Boiling Solvent | Remarks |
|---|---|---|---|---|
| 2 | (I-2) | — | (O-8) | " |
| 3 | (I-5) | — | (O-10) | " |
| 4 | (I-6) | — | (O-10) | " |
| 5 | (I-6) | — | (O-8) | " |
| 6 | (I-8) | — | (O-10) | " |
| 7 | (I-9) | — | (O-10) | " |
| 8 | (a) | — | (O-10) | " |
| 9 | (a) | (II-5) | — | " |
| 10 | (I-2) | (II-5) | — | Invention |
| 11 | (I-2) | (II-5) | (O-8) | " |
| 12 | (I-2) | (II-6) | (O-6) | " |
| 13 | (I-2) | (II-2) | (O-10) | " |
| 14 | (I-2) | (II-5) | — | " |
| 15 | (I-5) | (II-5) | (O-10) | " |
| 16 | (I-6) | (II-5) | — | " |
| 17 | (I-6) | (II-2) | (O-8) | " |
| 18 | (I-8) | (II-5) | (O-10) | " |
| 19 | (I-9) | (II-5) | (O-10) | " |

Coupler a

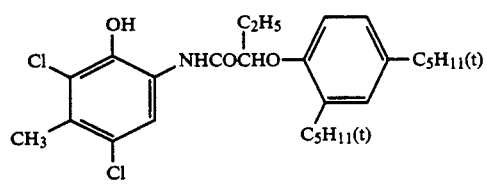

(Coupler described in JP-A-54-106228)

After exposure through a sensitometric continuous wedge, each sample was subjected to the following photographic processing.

| Color Photographic Processing Steps (33° C.): | |
|---|---|
| 1. Color Development | 3 min 30 sec |
| 2. Bleach-Fix | 1 min 30 sec |
| 3. Washing | 1 min 30 sec |

The processing baths used in the above-described steps were those described below.

| | |
|---|---|
| Color Developer: | |
| Benzyl Alcohol | 15.0 ml |
| Diethylene Glycol | 8.0 ml |
| Ethylenediaminetetraacetic Acid | 5.0 g |
| Sodium Sulfite | 2.0 g |
| Potassium Carbonate (anhydrous) | 30 g |
| Hydroxylamine Sulfate | 3.0 g |
| Potassium Bromide | 0.6 g |
| 4-Amino-N-ethyl-N-(β-methanesulfonamidoethyl)-m-toluidinesesquisulfate Monohydrate | 5.0 g |
| Water to make | 1 liter |
| pH | 10.2 |
| Bleach-Fix Bath: | |
| Ethylenediaminetetraacetic Acid | 4.0 g |
| Ethylenediaminetetraacetato Iron(III) Salt | 40 g |
| Sodium Sulfite | 5.0 g |
| Sodium Thiosulfate (70% soln.) | 150 ml |
| Water to make | 1 liter |

The processing was performed after the photosensitive materials had been processed in such a running condition so that no replenisher had been used, and a 1 liter portion of the color developer had been used for developing a 1 m$^2$ portion of the photosensitive materials.

Each of the developed samples was examined for the maximum density and gamma for the purpose of evaluating its color developability. The results are shown in Table 2.

Then, each of the developed samples was submitted to the following fastness tests.

One portion of each sample was allowed to stand for 6 days at 100 C in the dark in order to examine its heat resistance. Another portion of each sample was allowed to stand for 6 weeks in the dark under conditions of 60 C and 70% RH, in order to examine its high temperature and high humidity resistance. Still another portion of each sample was exposed to light for 6 days using a xenon tester (100,000 lux) in order to examine its light resistance. The fastness of the color image in each test was represented by the percentage of the lowering of color density in the area having an initial density of 1.0. Cyan coloration in the white background area was represented by an increase in blue density caused in the unexposed area by the 10 day storage under 80 C. The results obtained are shown in Table 2.

TABLE 2

| Sample Film | Color Developability: Maximum Density | Color Developability: Gamma | Resistances: Heat | Resistances: High Temperature and High Humidity | Resistances: Light | Cyan Coloration | Note |
|---|---|---|---|---|---|---|---|
| 1 | 2.44 | 2.08 | 26 | 7 | 25 | 0.12 | Comparison |
| 2 | 2.50 | 2.12 | 25 | 7 | 22 | 0.15 | " |
| 3 | 2.01 | 1.86 | 22 | 5 | 36 | 0.10 | " |
| 4 | 1.98 | 1.84 | 21 | 5 | 37 | 0.08 | " |
| 5 | 2.10 | 1.91 | 22 | 6 | 36 | 0.11 | " |
| 6 | 2.32 | 2.04 | 23 | 5 | 34 | 0.10 | " |
| 7 | 2.02 | 2.01 | 21 | 6 | 36 | 0.08 | " |
| 8 | 2.34 | 1.94 | 61 | 15 | 38 | 0.07 | " |
| 9 | 2.41 | 1.97 | 59 | 14 | 39 | 0.06 | " |
| 10 | 2.66 | 2.21 | 23 | 6 | 23 | 0.02 | Invention |
| 11 | 2.56 | 2.19 | 24 | 6 | 22 | 0.03 | " |
| 12 | 2.58 | 2.20 | 22 | 5 | 23 | 0.02 | " |
| 13 | 2.57 | 2.21 | 22 | 6 | 23 | 0.02 | " |
| 14 | 2.56 | 2.19 | 23 | 6 | 22 | 0.04 | " |
| 15 | 2.38 | 2.04 | 20 | 4 | 27 | 0.01 | " |
| 16 | 2.41 | 2.11 | 21 | 5 | 28 | 0.01 | " |
| 17 | 2.40 | 2.12 | 20 | 4 | 26 | 0.02 | " |
| 18 | 2.37 | 2.06 | 21 | 4 | 27 | 0.02 | " |
| 19 | 2.34 | 2.05 | 22 | 5 | 26 | 0.01 | " |

As can be seen from the data in Table 2, the combination of the present invention ensured high color developability and marked reduction in cyan coloration. In addition, excellent resistance against discoloration caused by exposure to heat, high temperature and high humidity atmosphere, or light, were achieved by the combination of the present invention.

On the other hand, the combination with the cyan coupler of the phenol type which has methyl group at the 5-position, described in JP-A-54-106228, had little effect upon the prevention of cyan coloration, and what is worse, caused considerable deterioration in fastness (e.g., in Samples 8 and 9). In these respects also, the combination of the present invention was ascertained to have superiority.

EXAMPLE 2

On a paper support laminated with polyethylene on both sides thereof were coated the layers described below to prepare Multilayer Photographic Paper A-1. The coating compositions were prepared in the following manner.

Preparation of Coating Composition for First Layer

To 10.2 g of Yellow coupler (Y-1), 9.1 g of Yellow Coupler (Y-2) and 4.4 g of Color Image Stabilizer (Cpd-1) were added 27.2 ml of ethyl acetate and 7.7 ml (8.0 g) of the high boiling point organic solvent (the foregoing 0-10) to prepare a solution. This solution was dispersed, in an emulsified condition, into 185 ml of a 10% aqueous gelatin solution containing 8 ml of a 10% solution of sodium dodecylbenzenesulfonate. The resulting emulsified dispersion was mixed with Emulsions EM1 and EM2, and homogeneously dispersed thereinto. Then, gelatin was further added to adjust the gelatin concentration to the value in the first layer composition, as described below.

The coating compositions for forming the second layer to the seventh layer, respectively, were prepared in a similar manner as the first layer.

The sodium salt of 1-oxy-3,5-dichloro-s-triazine was used as the gelatin hardener in each layer, and Compound (Cpd-12) was used as the viscosity increasing agent in each composition.

The composition of each layer is described below. The numbers therein indicate the amounts expressed in g/m$^2$. However, the amounts of silver halide emulsions are based on silver.

Support

The polyethylene laminated on the first layer side contained a white pigment ($TiO_2$) and a bluish dye.

| | |
|---|---|
| First Layer: Blue-Sensitive Layer | |
| Monodisperse silver chlorobromide emulsion (EM1) spectrally sensitized with sensitizing dye (ExS-1) | 0.13 |
| Monodisperse silver chlorobromide emulsion (EM2) spectrally sensitized with sensitizing dye (ExS-1) | 0.13 |
| Gelatin | 1.86 |
| Yellow coupler (Y-1) | 0.44 |
| Yellow coupler (Y-2) | 0.39 |
| Color image stabilizer (Cpd-1) | 0.19 |
| Solvent (the foregoing O-10) | 0.35 |
| Second Layer: Color Stain Inhibiting Layer | |
| Gelatin | 0.99 |
| Color mixing inhibitor (Cpd-3) | 0.08 |
| Third Layer: Green-Sensitive Layer | |

-continued

| | |
|---|---|
| Monodisperse silver chlorobromide emulsion spectrally sensitized with sensitizing dyes (ExS-2 and ExS-3) | 0.05 |
| Monodisperse silver chlorobromide emulsion (EM4) spectrally sensitized with sensitizing dyes (ExS-2 and ExS-3) | 0.11 |
| Gelatin | 1.80 |
| Magenta coupler (the foregoing M-5) | 0.32 |
| Color image stabilizer (Cpd-2) | 0.24 |
| Solvent (the foregoing O-8) | 0.12 |
| Solvent (the foregoing O-1) | 0.25 |
| Color image stabilizer (Cpd-8) | 0.03 |
| Color image stabilizer (Cpd-9) | 0.02 |
| Fourth Layer: Ultraviolet Absorbing Layer | |
| Gelatin | 1.60 |
| Ultraviolet absorbent (UV-1) | 0.62 |
| Color mixing inhibitor (Cpd-3) | 0.05 |
| Solvent (the foregoing O-2) | 0.24 |
| Fifth Layer: Red-Sensitive Layer | |
| Monodisperse silver chlorobromide emulsion (EM5) spectrally sensitized with sensitizing dyes (ExS-4 and ExS-5) | 0.07 |
| Monodisperse silver chlorobromide emulsion (EM6) spectrally sensitized with sensitizing dyes (ExS-4 and ExS-5) | 0.16 |
| Gelatin | 1.44 |
| Cyan coupler (the foregoing I-2) | 0.40 |
| Color image stabilizer (Cpd-10) | 0.17 |

-continued

| | |
|---|---|
| Color image stabilizer (Cpd-13) | 0.015 |
| Dispersing polymer (Cpd-11) | 0.20 |
| High boiling point organic solvent (the foregoing O-8) | 0.24 |
| Sixth Layer: Ultraviolet Absorbing Layer | |
| Gelatin | 0.54 |
| Ultraviolet absorbent (UV-1) | 0.21 |
| Solvent (the foregoing O-2) | 0.08 |
| Stabilizer (Cpd-3) | 0.02 |
| Seventh Layer: Protective Layer | |
| Gelatin | 1.33 |
| Acryl denatured copolymer of polyvinyl alcohol (denaturing degree: 17%) | 0.17 |
| Liquid paraffin | 0.03 |

Further, the irradiation inhibiting dyes (Cpd-4) and (Cpd-5) were used therein.

Furthermore, Alkanol B (produced by Du Pont), sodium alkylbenzenesulfonate, succinic acid esters and Megafac F-120 (produced by Dai Nippon Ink & Chemicals, Inc.) were used in each layer as emulsifying dispersants and coating aids. In addition, silver halide stabilizers (Cpd-6) and (Cpd-7) were also incorporated.

The compounds used in this example are illustrated below. As for the couplers, those cited as specific examples hereinbefore are employed.

ExS-1

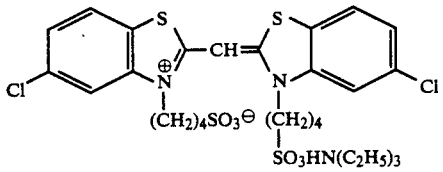

ExS-2

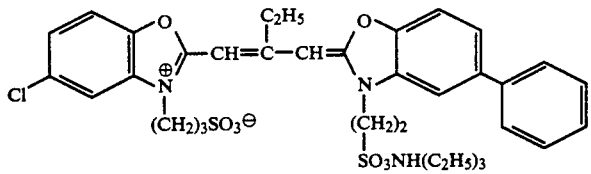

ExS-3

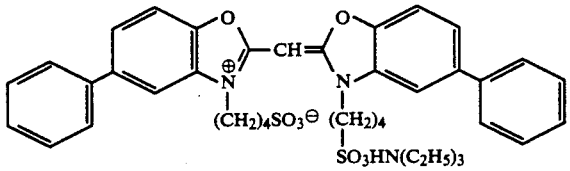

ExS-4

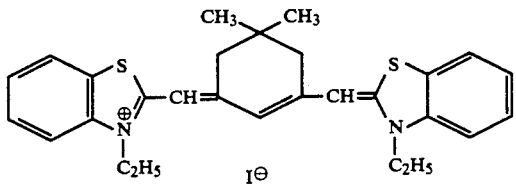

-continued
ExS-5
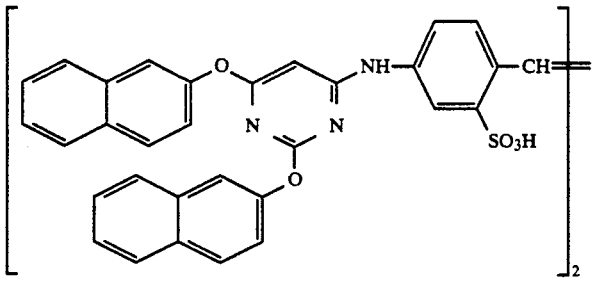
Y-1
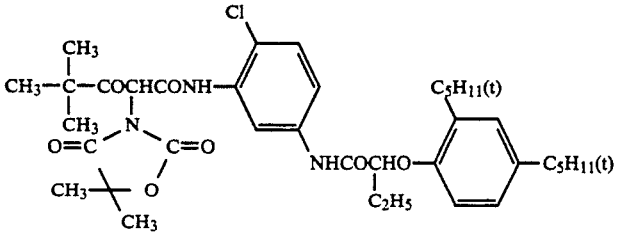
Y-2
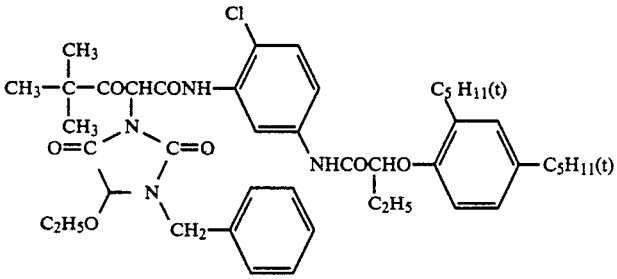
M-5
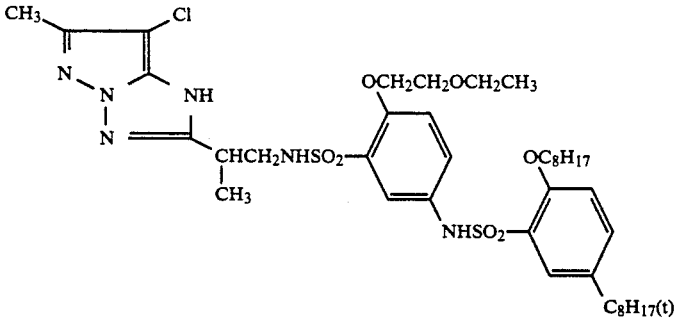
Cpd-1
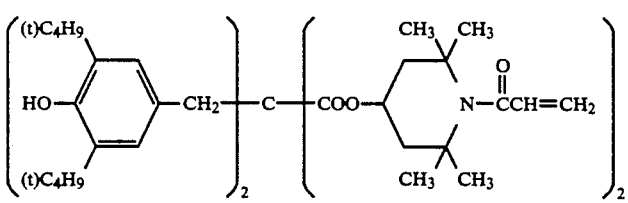
Cpd-2
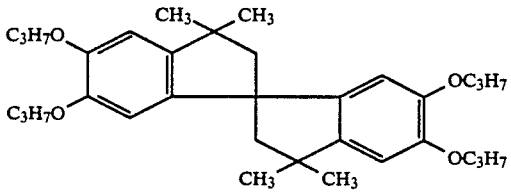

-continued
Cpd-3
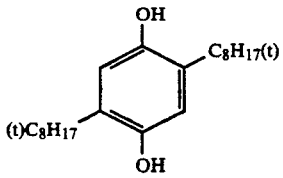
Cpd-4
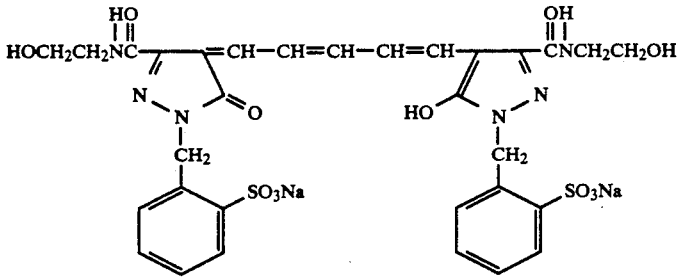
Cpd-5
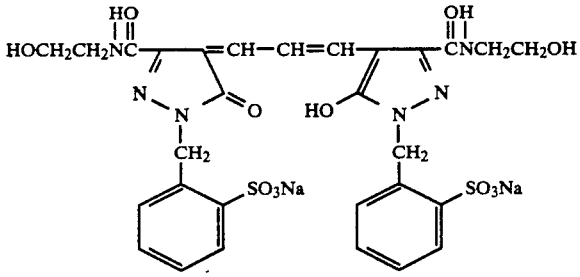
Cpd-6
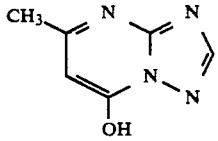
Cpd-7
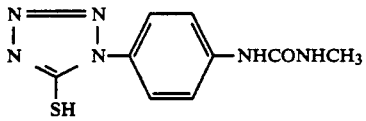
Cpd-8
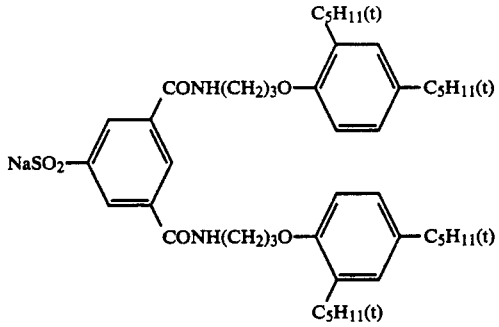
Cpd-9
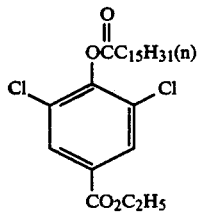
(Ultraviolet absorbent) 2:9:8 (by weight) mixture of UV-1

-continued
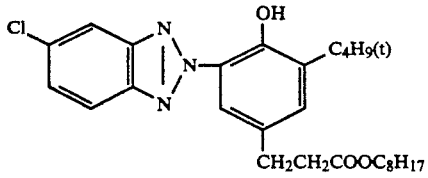
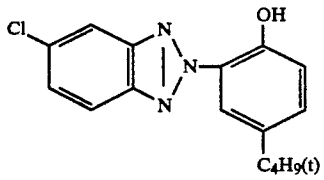
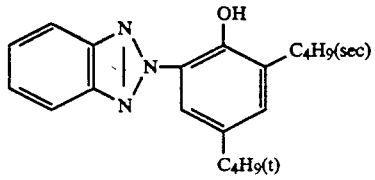
5:8:9 (by weight) mixture of Cpd-10
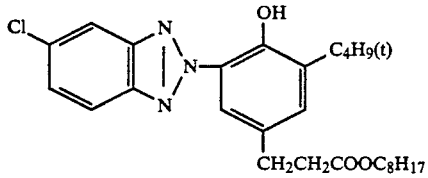
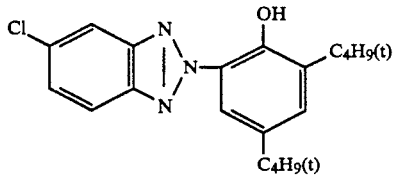
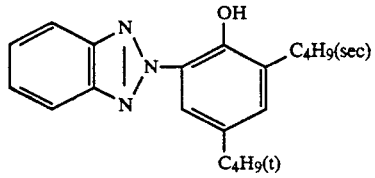
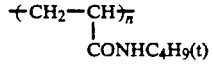
Cpd-11
(mean molecular weight: 80,000)
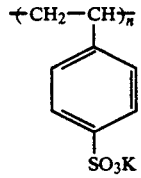
Cpd-12
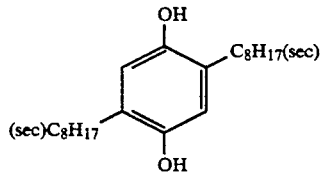
Cpd-13

| EM1 to EM6: Silver chlorobromide | | | | |
|---|---|---|---|---|
| Emulsion | Grain Form | Average Grain Size*1 (μm) | Br (mol %) | Variation Coefficient*2 |
| EM1 | Cube | 1.0 | 80 | 0.08 |
| EM2 | " | 0.75 | 80 | 0.07 |
| EM3 | " | 0.5 | 83 | 0.09 |
| EM4 | " | 0.4 | 83 | 0.10 |
| EM5 | " | 0.5 | 73 | 0.09 |
| EM6 | " | 0.4 | 73 | 0.10 |

*1An average of projected edge lengths.
**2A ratio of the statistical standard deviation (s) to the average grain size ($\bar{d}$) ($s/\bar{d}$).

Further, Samples (A-2) TO (A-14) were produced in the same manner as Sample (A-1), except only the coupler, the additive represented by formulae (II) or (III), and/or the high boiling point organic solvent among the ingredients constituting the fifth layer (i.e., the red-sensitive layer), were replaced by those set forth in Table 3.

The thus-obtained Samples (A-1) to (A-14) were exposed to light through an optical wedge, and processed according to the following photographic processing (I) after the running procedure had been performed under the conditions that no replenisher had been used, and a 1 liter portion of the color developer had been used for developing a 1 $m^2$ portion of the photosensitive materials.

The thus-developed samples were evaluated with respect to cyan coloration according to the same method as in Example 1.

| Photographic Processing (II): | | |
|---|---|---|
| Step | Temperature (°C.) | Time |
| Color Development | 38 | 1 min 40 sec |
| Bleach-Fix | 30–34 | 1 min 00 sec |
| Rinsing (1) | 30–34 | 20 sec |
| Rinsing (2) | 30–34 | 20 sec |
| Rinsing (3) | 30–34 | 20 sec |
| Drying | 70–80 | 50 sec |

(The rinsing step was performed according to the 3-tank countercurrent process, in which the current of the rinsing solution was made to flow in the direction from the rinsing (3) toward the rinsing (1).)

The composition of the processing solutions used were as follows.

| | |
|---|---|
| Color Developer: | |
| Water | 800 ml |
| Diethylenetriaminepentaacetic Acid | 1.0 g |
| 1-Hydroxyethylidene-1,1-diphosphonic Acid (60%) | 2.0 g |
| Nitrilotriacetic Acid | 2.0 g |
| Benzyl Alcohol | 16 ml |
| Diethylene Glycol | 10 ml |
| Sodium Sulfite | 2.0 g |
| Potassium Bromide | 0.5 g |
| Potassium Carbonate | 30 g |
| N-Ethyl-N-(β-methanesulfonamidoethyl)-3-methyl-4-aminoaniline Sulfate | 5.5 g |
| Hydroxylamine Sulfate | 3.0 g |
| Brightening Agent (WHITEX4B, produced by Sumitomo Chemical Co., Ltd.) | 1.5 g |
| Water to make | 1,000 ml |
| pH (at 25° C.) | 10.25 |
| Bleach-Fix Bath: | |
| Water | 800 ml |

-continued

| | |
|---|---|
| Ammonium Thiosulfate (70% soln.) | 200 ml |
| Sodium Sulfite | 20 g |
| Ammonium Ethylenediaminetetraacetato Ferrate(III) | 60 g |
| Disodium Ethylenediaminetetraacetate | 10 g |
| Water to make | 1,000 ml |
| pH (at 25° C.) | 7.00 |
| Rinsing Bath: | |
| Benzotriazole | 1.0 g |
| Ethylenediamine-N,N,N',N'-tetramethylene-phosphonic Acid | 0.3 g |
| Water to make | 1,000 ml |
| pH (at 25° C.) | 7.50 |

TABLE 3

| Sample Film | Coupler | Additive | High Boiling Solvent | Cyan Coloration | Remarks |
|---|---|---|---|---|---|
| A-1 | (I-2) | — | (O-8) | 0.04 | Comparison |
| A-2 | (I-5) | — | (O-8) | 0.03 | " |
| A-3 | (I-6) | — | (O-8) | 0.03 | " |
| A-4 | (I-8) | — | (O-8) | 0.04 | " |
| A-5 | (I-9) | — | (O-8) | 0.03 | " |
| A-6 | (I-2) | (II-5) | (O-8) | 0.01 | Invention |
| A-7 | (I-2) | (II-5)* | (O-8) | 0.00 | " |
| A-8 | (I-2) | (III-2) | — | 0.00 | " |
| A-9 | (I-2) | (III-2) | (O-8) | 0.01 | " |
| A-10 | (I-5) | (II-5) | — | 0.00 | " |
| A-11 | (I-6) | (II-5) | — | 0.00 | " |
| A-12 | (I-8) | (II-5) | (O-8) | 0.01 | " |
| A-13 | (I-9) | (II-5)* | (O-8) | 0.00 | " |
| A-14 | (I-9) | (II-5) | (O-8) | 0.01 | " |

*Cpd-8 and Cpd-9 were added in their respective proportions of 3 mol % to the coupler.

EXAMPLE 3

Multilayer Photographic Papers B-1 to B-14 were produced in the same manner as Multilayer Photographic Papers A-1 to A-14 in Example 2, except Emulsions EM1 to EM6 were replaced by Emulsions EM7 to EM12 described below, respectively. In a manner analogous to Example 2, these photographic papers were exposed, and processed according to the photographic processing (III). Thereupon, results similar to those in Example 2 were obtained. (Cyan coloration in the comparative samples was within the range of +0.02 to +0.03, while in the present samples it was not observed at all.)

| Emulsion | Grain Form | Average Grain Size*1 (μm) | Br (mol %) | Variation Coefficient*2 |
|---|---|---|---|---|
| EM7 | Cube | 1.1 | 1.0 | 0.10 |
| EM8 | " | 0.8 | 1.0 | 0.10 |
| EM9 | " | 0.45 | 1.5 | 0.09 |
| EM10 | " | 0.34 | 1.5 | 0.09 |
| EM11 | " | 0.45 | 1.5 | 0.09 |
| EM12 | " | 0.34 | 1.6 | 0.10 |

*1An average of projected edge lengths.
**2A ratio of the statistical standard deviation (s) to the average grain size ($\bar{d}$) ($s/\bar{d}$).

| Photographic Processing (III): | | |
|---|---|---|
| Step | Temperature (°C.) | Time (sec) |
| Color Development | 35 | 45 |
| Bleach-Fix | 33–35 | 45 |
| Rinsing (1) | 30–35 | 20 |
| Rinsing (2) | 30–35 | 20 |

-continued

| Photographic Processing (III): | | |
|---|---|---|
| Step | Temperature (°C.) | Time (sec) |
| Rinsing (3) | 30–35 | 20 |
| Rinsing (4) | 30–35 | 30 |
| Drying | 70–80 | 60 |

(The rinsing step was performed according to the 4-tank countercurrent process, in which the current of the rinsing solution was made to flow in the direction from the rinsing (4) toward the rinsing (1).)

The compositions of the processing baths used were as follows.

| | |
|---|---|
| Color Developer: | |
| Water | 800 ml |
| Ethylenediamine-N,N,N,N-tetramethylene-phosphonic Acid | 1.5 g |
| Triethylenediamine(1,4-diazabicyclo[2,2,2]-octane) | 5.0 g |
| Sodium Chloride | 1.4 g |
| Potassium Carbonate | 25 g |
| N-Ethyl-N-(β-methanesulfonamidoethyl)-3-methyl-4-aminoaniline Sulfate | 5.0 g |
| N,N-Diethylhydroxylamine | 4.2 g |
| Brightening Agent (UVITEX CK, produced by Ciba Geigy) | 2.0 g |
| Water to make | 1,000 ml |
| pH (at 25° C.) | 10.10 |
| Bleach-Fix Bath: | |
| Water | 400 ml |
| Ammonium Thiosulfate (70% soln.) | 100 ml |
| Sodium Sulfite | 18 g |
| Ammonium Ethylenediaminetetraacetato Ferrate(III) | 55 g |
| Disodium Ethylenediaminetetraacetate | 3 g |
| Ammonium Bromide | 40 g |
| Glacial Acetic Acid | 8 g |
| Water to make | 1,000 ml |
| pH (at 25° C.) | 5.5 |

Rinsing Bath

Ion exchange water $Ca^{2+}$ and $Mg^{2+}$ concentrations were each below 3 ppm)

Effect of the Invention

A color photograph having a developed cyan color image excellent in resistance to light, head and moisture is obtained by using the combination of the cyan coupler of formula (I) and a compound represented by formulae (II) or (III), in accordance with the present invention.

In addition, this combined use according to the present invention has a great advantage in that cyan coloration (Stain) is hardly caused in the white background area (color undeveloped area) of the color photograph by a lapse of time.

Further, the present invention can depress the above-described cyan coloration even when a silver halide photographic material containing a cyan coupler of the type which has high color producibility is processed with a color developer substantially free from benzyl alcohol.

While the invention has been described in detail and with reference to specific embodiments thereof, it will be apparent to one skilled in the art that various changes and modifications can be made therein without departing from the spirit and scope thereof.

What is claimed is:

1. A silver halide photographic material which contains, on a support, at least one cyan dye-forming coupler represented by the following formula (I), and at least one compound selected from among those represented by the following formulae (II) and (III);

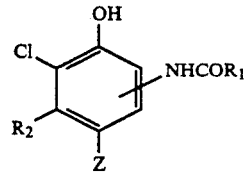

(I)

$$L_1(COOR_3)_n \quad \text{(II)}$$

$$L_2(OCOR_4)_m \quad \text{(III)}$$

wherein $R_1$ represents an aliphatic group, an aromatic group or a heterocyclic group; $R_2$ represents an ethyl group, Z represents a hydrogen atom, or a group or an atom capable of splitting off upon coupling with a developing agent; $L_1$ and $L_2$ each represents a divalent aliphatic group; $R_3$ and $R_4$ each represents an aliphatic group; n and m each represents an integer of 2, and the n $R_3$'s and m $R_4$'s, respectively, may be the same of different, $L_2$ excludes cyclohexylene group; wherein the total number of carbon atoms in the compound represented by formula (II) is from 12 to 60 and the total number of carbon atoms in the compound represented by formula (III) is from 12 to 60, and wherein said compound represented by formula (I) and said at least one compound represented by formula (II) or (III) are present in the same layer.

2. A silver halide photographic material as in claim 1, wherein $R_1$ is an unsubstituted alkyl group having from 12 to 18 carbon atoms; Z is a hydrogen or halogen atom.

3. A silver halide photographic material as in claim 1, wherein said compound represented by formulae (II) or (III) is contained in an amount of from 0.1 to 10 parts by weight per part by weight of said coupler represented by formula (I).

4. A silver halide photographic material as in claim 1, further comprising, in the layer containing said cyan dye forming coupler represented by formula (I) or a different layer, a cyan coupler represented by formula (C-1);

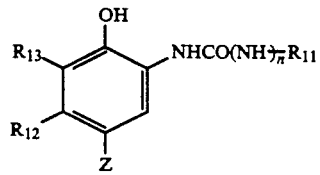

(C-I)

wherein $R_{11}$ represents an aliphatic group, an aromatic group, or a heterocyclic group; $R_{12}$ represents a methyl group or an acylamino group; $R_{13}$ represents a hydrogen atom, a halogen atom, an aliphatic group, an aromatic group, an aliphatic or aromatic oxy group, or an acylamino group; $Z_{11}$ represents a hydrogen atom, or a group eliminable by oxidative coupling with a color developing agent; and n is 0 or 1, with the proviso that $R_{12}$ and $R_{13}$ may combine with each other to complete a 5- to 7-membered ring.

5. A silver halide photographic material as in claim 1, further comprising a yellow coupler selected from the following formulae (Y-1) and (Y-2):

(Y-1)

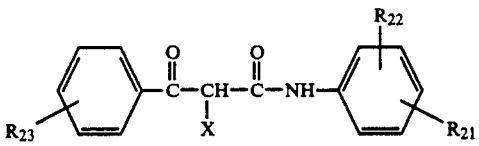

(Y-2)

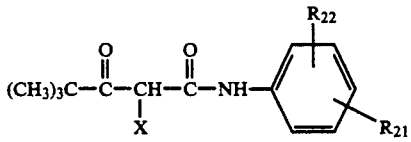

wherein X represents a hydrogen atom or a coupling eliminable group; $R_{21}$ represents a nondiffusible group having from 8 to 32 carbon atoms, and $R_{22}$ represents a hydrogen atom, one or more of a halogen atom, a lower alkyl group, a lower alkoxy group, or a nondiffusible group having from 8 to 32 carbon atoms; and $R_{23}$ represents a hydrogen atom, or a substituent group, with the proviso that when two or more $R_{23}$'s are present, they may be the same or different.

6. A silver halide photographic material as in claim 1, further comprising a magenta coupler selected from among those represented by the following formulae (M-1), (M-2) and (M-3);

(M-1)

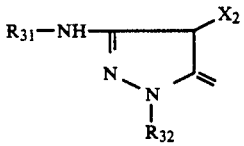

-continued (M-2)

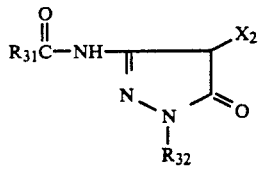

(M-3)

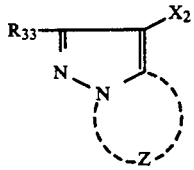

wherein $R_{31}$ represents a nondiffusible group having from 8 to 32 carbon atoms in all; $R_{32}$ represents an unsubstituted or substituted phenyl group; $R_{33}$ represents a hydrogen atom, or a substituent group; and Z represents nonmetal atoms necessary to complete a 5-membered ring containing from 2 to 4 nitrogen atoms, and the azole ring therein may have a substituent group; and $X_2$ represents a hydrogen atom or a coupling eliminable group.

7. A silver halide photographic material as in claim 1, further comprising an ultraviolet absorbent represented by formula (XI):

(XI)

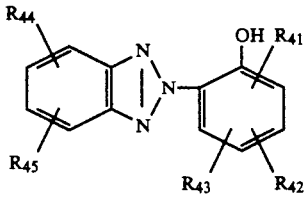

wherein $R_{41}$, $R_{42}$, $R_{43}$, $R_{44}$ and $R_{45}$, which may be the same or different, each being a hydrogen atom or a substituent group; $R_{44}$ and $R_{45}$ may combine with each other to complete a 5- or 6-membered aromatic a carbon ring and these groups and this aromatic ring may further be substituted by a substituent group.

8. A silver halide photographic material as in claim 7, wherein said ultraviolet absorbent is contained in an amount of from $1\times10^{-4}$ to $2\times10^{-3}$ mol/m$^2$.

* * * * *